US008196785B2

(12) United States Patent
de Carvalho

(10) Patent No.: US 8,196,785 B2
(45) Date of Patent: Jun. 12, 2012

(54) AIR VENT FOR LIQUID CONTAINERS, BASED ON THE PRINCIPLE OF COMMUNICATING VESSELS

(76) Inventor: David de Carvalho, São Paulo (BR)

( * ) Notice: Subject to any disclaimer, the term of this patent is extended or adjusted under 35 U.S.C. 154(b) by 50 days.

(21) Appl. No.: 12/914,256

(22) Filed: Oct. 28, 2010

(65) Prior Publication Data

US 2011/0042340 A1 Feb. 24, 2011

Related U.S. Application Data

(62) Division of application No. 10/934,257, filed on Sep. 3, 2004, now abandoned.

(30) Foreign Application Priority Data

Dec. 17, 2003 (BR) ..... 0300664

(51) Int. Cl.
*A61J 9/04* (2006.01)

(52) U.S. Cl. ..... 222/481.5; 222/479; 222/482; 215/11.5; 215/902; 220/745

(58) Field of Classification Search ..... 222/188, 222/478, 479, 481, 481.5, 482, 484; 215/11.1, 215/11.5, 307, 309, 385, 902; 220/745; 141/285, 141/300, 309
See application file for complete search history.

(56) References Cited

U.S. PATENT DOCUMENTS

| | | | | | |
|---|---|---|---|---|---|
| 189,691 | A | | 4/1877 | Briere | |
| 345,518 | A | | 7/1886 | Lelievre | |
| 493,877 | A | * | 3/1893 | Schleuter | 222/188 |
| 598,231 | A | | 2/1898 | Roderick | |
| 679,144 | A | | 7/1901 | Hardesty | |
| 834,014 | A | | 10/1906 | Lyke | |
| 979,607 | A | | 12/1910 | Van Cleave | |
| 1,527,204 | A | | 2/1925 | McCormick | |
| 1,855,373 | A | | 4/1932 | Willumsen | |
| 2,239,275 | A | | 4/1941 | Schwab | |
| 2,378,205 | A | * | 6/1945 | Fevas | 215/378 |
| 2,620,487 | A | * | 12/1952 | Vierra | 4/227.5 |
| 2,742,168 | A | | 4/1956 | Panetti | |
| 2,744,646 | A | | 5/1956 | Blackstone | |
| 2,986,310 | A | | 5/1961 | Spaulding | |
| 3,683,978 | A | | 8/1972 | Jones et al. | |
| 3,774,813 | A | | 11/1973 | Vanderveen | |
| 3,851,800 | A | | 12/1974 | Swain | |
| 1,600,804 | A | | 9/1976 | Donaldson | |
| 5,007,565 | A | * | 4/1991 | Richter et al. | 222/481 |

(Continued)

*Primary Examiner* — J. Casimer Jacyna
(74) *Attorney, Agent, or Firm* — Alston & Bird LLP

(57) ABSTRACT

An air vent for liquid containers such as baby bottles, flasks, or the like, for containing any liquid easily poured through an upper spout such as a nipple or a hard plastic spout or even a metal spout. The container includes an air vent defined by a system based on the principle of communicating vessels acted upon by equal air pressures, defined by a duct of an adequate diameter placed in a vertical or oblique manner, whose lower end is placed inside and in the bottom of the container, while the upper end defines an external air inlet that is open to external air. The duct communicates with the main internal space in the bottom of the container, such that when the container is sufficiently tilted, the liquid inside the duct may go to the bottom of the container, enabling a free flow of external air to the bottom of the container, without passing through the liquid, thus preventing the formation of a vacuum in the bottom of the container, before even this same liquid be discharged or sucked from the container.

10 Claims, 41 Drawing Sheets

U.S. PATENT DOCUMENTS

| | | | |
|---|---|---|---|
| 5,097,992 | A | 3/1992 | Shiemann |
| 5,284,261 | A | 2/1994 | Zambuto |
| 5,570,796 | A | 11/1996 | Brown et al. |
| 5,678,710 | A | 10/1997 | Sheu |
| 5,692,627 | A | 12/1997 | Feng |
| 6,138,710 | A | 10/2000 | Chomik et al. |
| 6,138,877 | A | 10/2000 | Goff |
| 6,349,116 | B1 | 2/2002 | Hash et al. |
| 6,577,275 | B2 | 6/2003 | Turner |
| 6,859,485 | B2 | 2/2005 | Belcher |

* cited by examiner

A-A

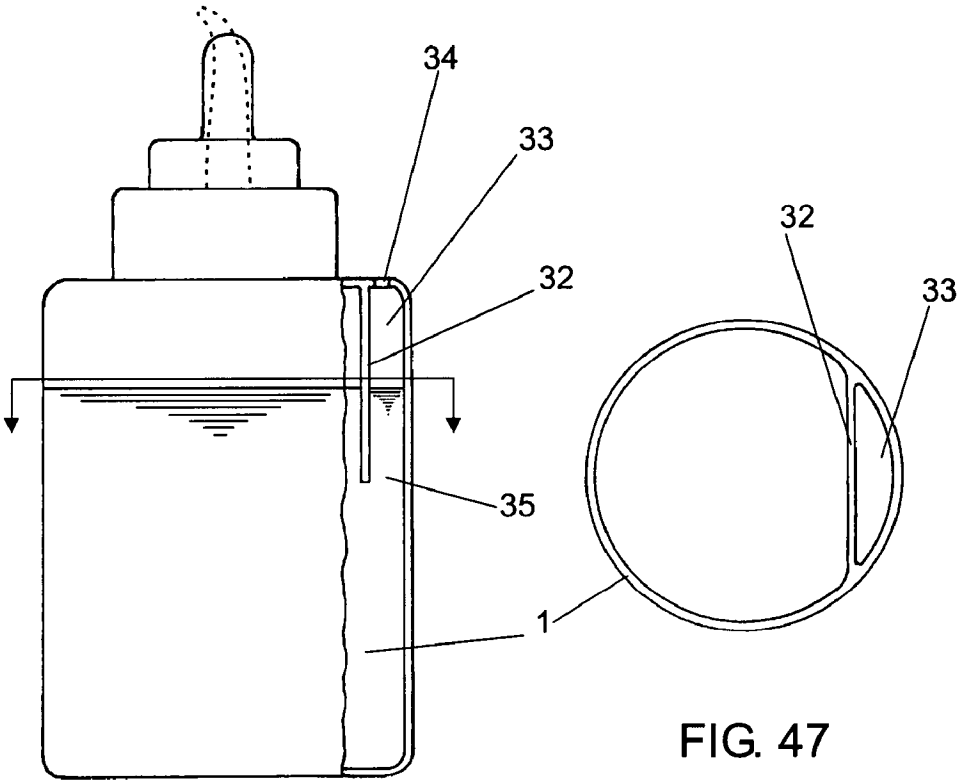
FIG. 47
FIG. 46
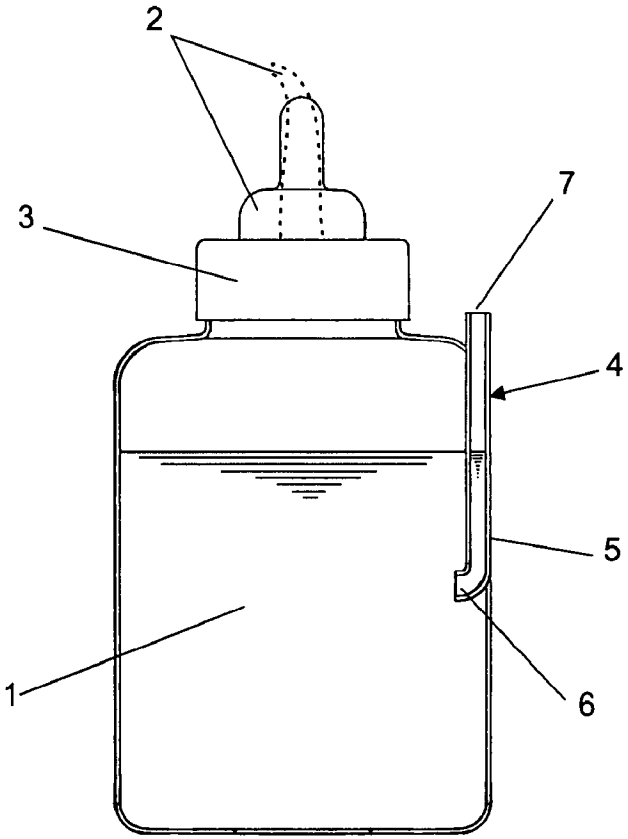
FIG. 45

A-A

AIR VENT FOR LIQUID CONTAINERS, BASED ON THE PRINCIPLE OF COMMUNICATING VESSELS

CROSS-REFERENCE TO RELATED APPLICATION

The present application is a divisional of application Ser. No. 10/934,257 filed on Sep. 3, 2004 now abandoned, the entire disclosure of which is hereby incorporated herein by reference.

BACKGROUND OF THE INVENTION

The present invention relates to technical and functional enhancements especially created to characterise the means that significantly improve the use and the functioning of liquid containers. For this purpose, this invention defines an air vent or communicating means of an air inlet, adaptable to liquid containers whose body may be rigid, quasi-rigid or flexible, whereby the function of such an air vent aims at avoiding the formation of vacuum at the bottom of the container at the beginning, and during the discharge of liquid; logically, the neutralisation of the vacuum is obtained by the fact that the above mentioned air vent enables external air to be sent directly to the bottom of the container before the beginning of the discharge or of the liquid suction; and, this air flow does not even go through the liquid discharged, which thus provides different technical effects that are beneficial for the functioning of the entire set.

These properties are attained through using the principle of communicating vessels, balancing pressures, and building an adequate container project. The principle of communicating vessel establishes that: "The levels of liquid in two adjacent vessels are equal since the pressures on those levels are equal". So, when, two adjacent vessels have their tops open to atmosphere their levels are equal. When we tilt the vessels the levels inside of them will stay still and horizontal. Above certain angle, the liquid of the vessel which is in the upper position will flow to the vessel which is in the lower position. However, when one of the vessels (container body) has a lid with a spout/nipple and the other vessel (air vent tube) is open or close to atmosphere, it will be necessary that the container body and air vent tube have some characteristics to behave like the two adjacent vessels open to atmosphere, that is, to function according to the principle of communicating vessels, when they are tilted.

In almost all containers, the liquid outlet creates a vacuum at the bottom of the container, thereby requiring that external air go down to the bottom of the container so as to break the aforesaid vacuum and allows for a flow to occur.

In most cases, external air enters through the own discharge system or through an orifice in the closest outlets, and goes through the entire liquid before reaching the bottom of the container; an example of this: olive oil cans, cleaning product containers, some types of baby bottles, etc. In those cases, the flow is usually not uniform (gushes), and very often the container is also pressed to improve the outlet flow; however, this very often ends up making the product come out in an excess through the spout and the product may also come out through the air vent just like in olive oil containers, for instance.

There currently are some solutions enabling that an amount of air is introduced inside the container as the liquid comes out. Those solutions are used in baby bottles and other devices or containers. The research conducted came across some instructional documentation on the different solutions for the same problem, among which we may specify: U.S. Pat. No. 189,691 dated Apr. 17, 1876; U.S. Pat. No. 345,518 dated Jul. 13, 1886; U.S. Pat. No. 598,231 dated Feb. 1, 1898; U.S. Pat. No. 679,144 dated Jul. 23, 1901; U.S. Pat. No. 834,014 dated Oct. 23, 1909; U.S. Pat. No. 979,607 dated Dec. 27, 1910; U.S. Pat. No. 1,600,804 dated Sep. 21, 1926; U.S. Pat. No. 2,239,275 dated Apr. 22, 1941; U.S. Pat. No. 2,742,168 dated Apr. 17, 1956; U.S. Pat. No. 2,744,646 dated May 8, 1956; U.S. Pat. No. 5,284,261 dated Feb. 8, 1994; U.S. Pat. No. 5,692,627 dated Dec. 2, 1997; and U.S. Pat. No. 6,138,710 dated Oct. 31, 2000

In the above mentioned documents, and in the products currently marketed, many containers, including baby bottles in general, have different means to allow for the inlet of external air just as the liquid is discharged outwards. In many cases, the air vents are located on the lid of the container. As an example, we may refer to some olive oil containers, whose lid or cap has a device (valve) with a little tube which discharges the air into the liquid so that it cannot do any other than go through the liquid down to the bottom of the container, as the small tube does not go to the bottom of the container (where there is only air).

On the other hand, according to some of the above mentioned literature, baby bottles as well as some types currently manufactured make the air go to the bottom of the bottle in different manners, all of which aim at improving the drainage or outflow of the liquid.

For some traditional baby bottles, external air enters through the very hole of the nipple, or through orifices around the nipple, or even through apertures of the lid, or of the screw thread of the lid; the liquid then goes down to the bottom of the baby bottle. In those cases, the baby swallows the air along with the milk, which triggers off a series of consequences such as colic, gas, and other symptoms.

Some types of baby bottles have an air inlet at the bottom part, where various constructive details contribute to forming a kind of valve made of a combination of various apertures in a membrane assembled at the bottom of the bottle and fixed with a lid similar to that for the nipple; thus, as the bottle is turned downwards to start liquid suction, a certain amount of air enters through the membranous valve to eliminate the vacuum formed at the bottom of the bottle. This system undoubtedly improves the functioning of the baby bottle significantly; however, its industrial feasibility is complex and generates a substantial increase of the manufacturing cost, since the functioning ends up being equally as complex and requiring special cleaning care, besides the fact that the parts are disposable (membrane).

Another type of baby bottle has an air vent assembly formed by a small reservoir inside and coaxial to the bottle, which is connected to external air through an insert, which has an air vent tube, through which external air goes down through the reservoir, to the bottom of the bottle, without ever being in contact with the milk after the initial vacuum is gotten rid of. When the baby bottle is tilted the milk flows to the wider part of the reservoir and do not leak due to the insert. Although this type of baby bottle is constructed in a particular way and functions excellently, it requires a series of special care; in other words: it does not enable any sudden changes in handling (shaking, etc. . . . ) since in that case and in other similar ones leakage may occur through the air vent; the air is only sent to the bottom of the bottle after the baby starts sucking so that the vacuums forms at the bottom of the bottle and therefore, at the beginning, the milk located in the tube goes to the bottom of the bottle; also this type of air vent does not allow for the bottle to be warmed up in a bain-marie.

Finally, there is also a type of baby bottle whereby the air vent system or device that neutralizes the vacuum is formed by a flexible and disposable case, placed inside the bottle. Besides containing all the liquid, this case works as a pressing tank, that is, a kind of piston presses on the abovementioned case as the liquid goes out; this stops the formation of a vacuum as the aforesaid case changes shape, thereby no longer requiring air to enter inside.

In brief, the analysis of the above containers and other usual containers, shows that none of them has an air vent like the air vent tube proposed in this work, whose functioning is based on the principle of communicating vessels.

We should point out that two cases have been considered in this work. In the first case the external air will be at the container bottom, before the outflow is even started, it will not cross the liquid inside the container and there will not be vacuum at the beginning or during the outflow. In the second case, depending on the type of the usual container, it may fulfil the principle of communicating vessel, as in the above case, or it will not fulfil completely the above principle. Even in this last case the external air will also go down to the bottom of the container without crossing the liquid and there will not be vacuum during the outflow of the liquid.

SUMMARY OF THE INVENTION

In view of the abovementioned shortcomings and with the aim of overcoming them, the present air vent was created, whose technical and functional features have been especially developed to eliminate the vacuum produced inside a container at the beginning and during the phase, in which its contents are discharged or consumed, as when a child sucks milk for instance.

Therefore, though the air vent is to be used in liquid containers in general, we shall highlight the case of baby bottles. Thus, the technical and functional features described in this work can be used in containers for various types of liquids such as seasoning and flavouring containers for example, like olive oils, oils in general, vinegar, and other domestic and industrial containers. It is important to stress out that this particular air vent is ideal as to provide a regular discharge or consumption without any gushing, thereby contributing to controlling the flow and being economical and hygienic.

The main feature of this air vent is the fact that it defines an air inlet through a small vertical tube whose upper end is turned outwardly and designed to impound external air; this end is also located normally above the maximum level of liquid contained inside the container, whether it is a baby bottle or not, while the lower end is located inside and normally at the bottom of the container, thereby enabling a communicating-vessel system. This configuration defines an air vent for various types of liquid containers so that when the container is tilted, the external air is sent directly to the bottom of the container, logically thanks to the above mentioned tube, without ever being in contact with the liquid and, thus, the formation of a vacuum is completely eliminated at the beginning, and during the liquid flow; so, although there is a certain amount of liquid (communicating vessels) inside the air vent or in the above mentioned tube, when the container is tilted or starts discharging the liquid, there will no longer be any liquid inside the air vent tube as the air will already be going to the bottom of the container, that is, external air will already be in contact with the bottom of the container before the very beginning of the flow or sucking.

As it was mentioned before, the functioning of this particular air vent is based on the principle of communicating vessels (FIG-1A, B, C, and D) and on the balance of hydro-pneumatic pressures (FIG. 2A, B, and C), thereby providing a series of features and advantages, among which we may specify:

a) external air is directly sent to the bottom of the container without ever being in contact with the liquid;

b) in the case of baby bottles, the air and milk are kept separate, which stops the baby from making vacuums while sucking and having gases, gas colic, burping, and hiccups, the baby cannot intake a bit of air in any way whatsoever; in other words, we have a totally colic-free baby bottle;

c) external air goes directly to the bottom of the container, before the outflow of the liquid is even started and there will not be vacuum formation at the beginning or during the pouring or sucking.

d) in the case of baby bottles, external air will already be at the bottom of the bottle, before the baby even starts to suck; therefore, the baby will not have to make any effort to establish the initial vacuum, or during suction, at the bottom of the baby bottle;

e) it enables a regular flow as at the same time a volume of liquid is discharged, an equivalent volume of external air goes directly to the bottom of the container where there is only air;

f) it is more hygienic because there is no danger of leakage through the body and at the bottom of the container, and through the external air inlet vent, even during filling and emptying of the container, or when it is squeezed as in the case of flexible containers;

g) it is more cost-effective as you can control the liquid flow if the size of the air vent (tube diameter) and the outflow spout/nipple are adequately chosen, or devices are used to dose the air inlet and consequently dose the liquid outflow, which is ideal for some containers such as those for seasoning, eatable oils, etc.;

h) a simple air vent has been designed to avoid complex devices at the bottom, inside, or in the container, or the baby bottle, as well as intermediary parts and other complicated systems requiring assembling and disassembling of the set; this eliminates even the use of disposable parts or the periodical replacement of some given parts, and special cleaning care;

i) depending on how the set is to be applied, the tube forming the air vent may be placed inside or outside, or it may be part of the main body of the container, or of the baby bottle. It can be located in any position inside the container, from the center (coaxial) through near the inside of the container wall;

j) the air vent tube may have an air inlet at its upper end, which is then placed on the body or on the lid of the container or the baby bottle;

k) a small adaptation enables it to connect the air vent tube to a sucking device to allow sucking the liquid inside the container; and l) in the case of baby bottles, the devices already available on the market may be added for the baby to suck milk while sitting inside a car or in a pushchair, without needing to use its hands;

m) it enables to make sudden movements (shaking) to mix liquids or liquids and powders (chocolate, etc.); all you need to do is to close the external air inlet;

n) it enables to incline the container in several angles up to and above 180°, without any leakage through the air vent tube;

o) there is no need of reservoir at the upper part of the air vent tube, nor an auxiliary vent tube inside of the mentioned reservoir, for there is not any possibility of leakage, because there will be no liquid in the air vent tube before the pouring or sucking;

p) the length of the air vent tube can vary, from near the air inlet trough the bottom of the container, depending on the usage;

q) the air vent tube can be parallel (vertical) or oblique to the axis of the container. There is no need to be oblique as it could appear to be the case;

r) the air inlet of the air vent can be above or below the spout/nipple, above or below the liquid level inside the container; when below the liquid level, the construction and the use will need some handling care;

s) the air vent may have several shapes, provided it enables the realization of the principle of communicating vessel. It is not necessary to be rectilinear;

t) the container body and the air vent tube can have several cross-sections: circular, square, rectangular, a combination of them etc. In order to best explain it we will always consider a straight air vent with a circular cross-section and parallel to the axis of the container. In the case of baby bottles we may have a cross-section which enables to place it in the horizontal position due to reasons we will explain later;

u) the lid where the spout/nipple is located can be in right angle or oblique to the axis of the container;

v) the air vent tube can be located in any position of the container perimeter;

x) when the spout is open to atmosphere we obtain the realization of the principle of communicating vessels with any volume of air in between the liquid level and the container lid, that is, with any liquid level inside the container.

For testing purposes we have made prototypes using plastic containers including baby bottles and air vent plastic tubes with internal diameters of 1 mm to 6 mm.

BRIEF DESCRIPTION OF THE DRAWINGS

To understand this invention better, a detailed description is made below; it refers to the appended drawings, wherein:

FIGS. 37 to 49 illustrate different constructive versions taking into account the length of the air vent tube;

DETAILED DESCRIPTION OF THE INVENTION

As previously mentioned, this invention is based on the principle of communicating vessels and on the balance of pressures.

Figure 1B:
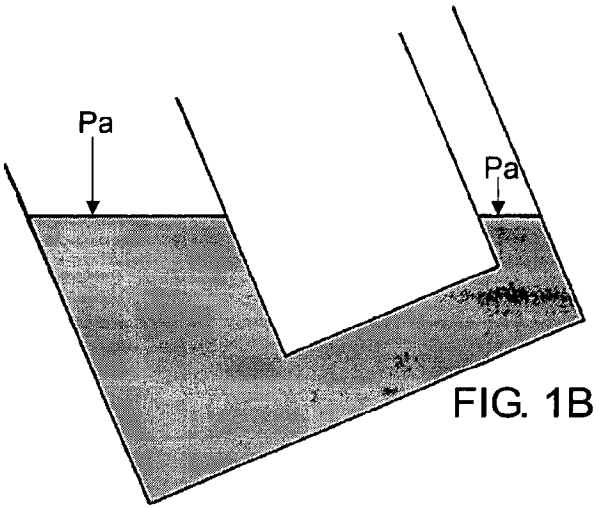
FIGS. 1A to 2C illustrate the principle of communicating vessels.
Figure 1D:
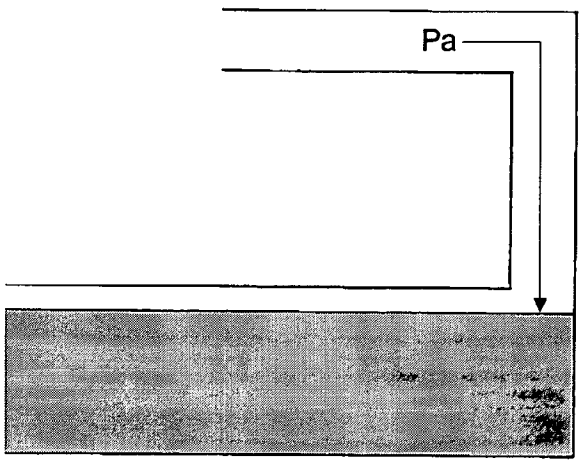
Figure 1A:
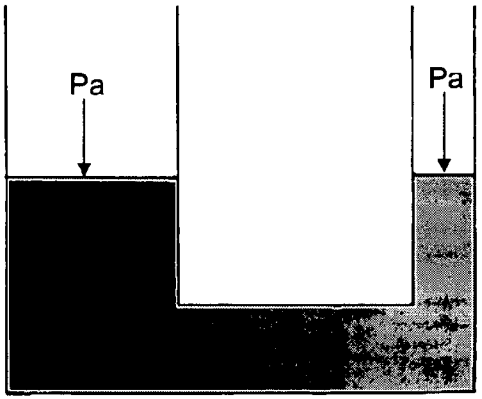

The principle of communicating vessels establishes that: "The levels of liquid in two adjacent vessels are the same provided the pressure on those levels is the same." (FIG. 1A).

Figure 1C:
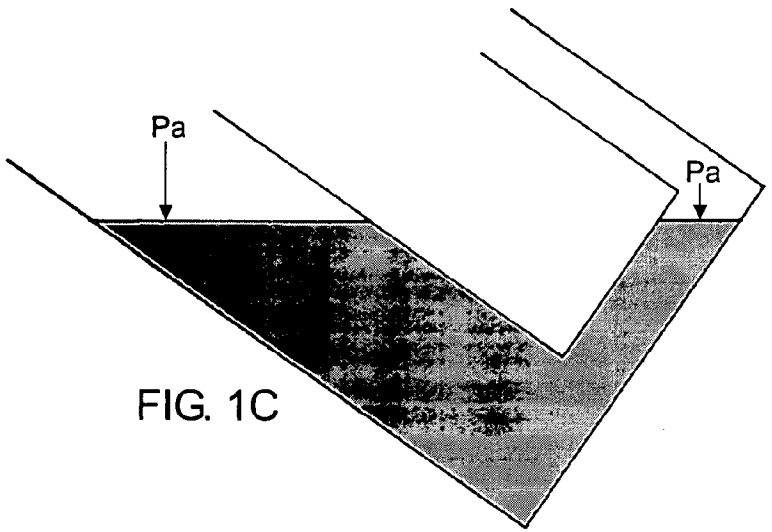

Due to that, when communicating vessels are tilted and the same pressure is maintained on the levels of both vessels (the atmospheric pressure usually), those levels are kept in a horizontal position so that the vessel placed above is emptied of its liquid when both vessels are almost horizontal (FIG. 1C). The horizontal position ensures that the upper vessel will be emptied of any liquid (FIG. 1D). The horizontal position is reached before the tilted position (lower vessel container turned downwards); this is when the liquid outflow starts in the lower vessel. Therefore, at the beginning of the liquid outflow of the lower vessel, external air is already going to the bottom of the lower vessel without forming the initial vacuum or even during the outflow. It is also interesting to note that no drop of the liquid can possibly flow out of the upper vessel.

This description is valid for two non-mixable liquids of equal density. If the densities are different, a difference in the levels of both liquids will occur, to be taken into account in the container design.

Figure 2A:
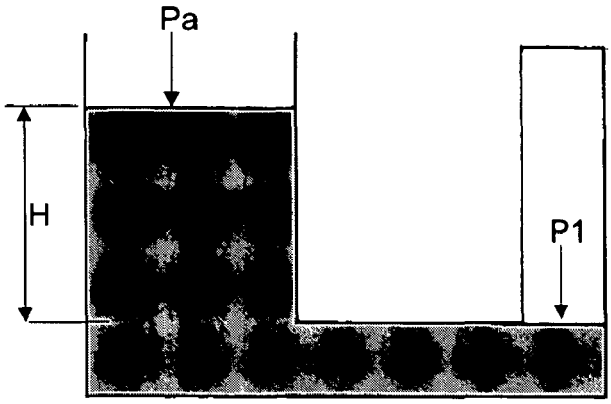

If the pressure on the liquid of one of the adjacent vessels is higher than the other, the levels will not be the same, and the liquid may not flow into the vessel under a higher pressure (FIG. 2A). In that case, if one of the vessels is kept closed, when the liquid is poured into the other, it will not flow into the closed vessel to make the levels even as in the case of the communicating vessels described above because of the balance in pressure that is established, as follows:

$P1 = Pa + HJ$, where:

P1=Pressure of the retained air,

Pa=Atmospheric pressure,

H=Difference in the level of the liquid in both vessels,

J=Specific weight of the liquid.

Therefore, P1>pa

Figure 2B:
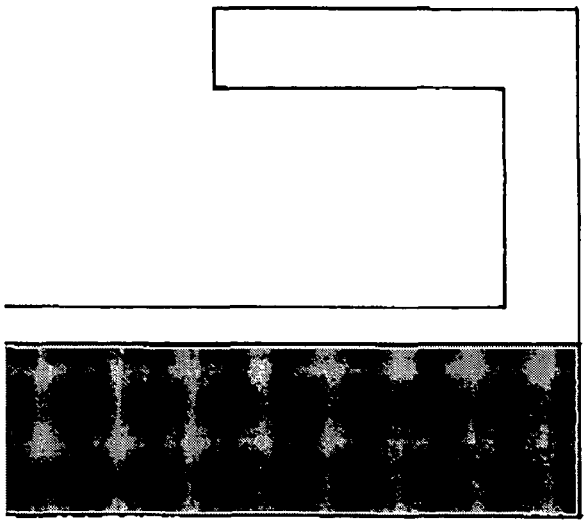
Figure 2C:
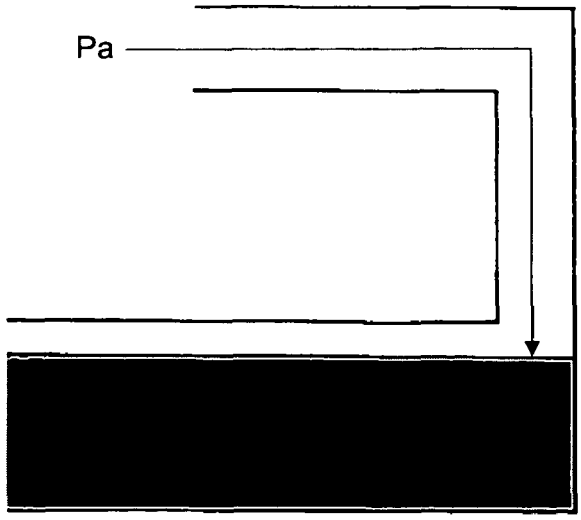

When tilting the adjacent vessels, keep the closed vessel above (FIG-2B) so that the liquid cannot possibly flow into the closed vessel because of the difference of pressures; and when the horizontal position is reached (FIG-2C) the closed vessel may be opened, thereby enabling external air to go to the bottom of the open (lower) vessel without needing to have any initial vacuum or even during the flow; and so, just as in the case of communicating vessels, the liquid will not flow in any possible way from the upper vessel that was closed.

Figure 4:
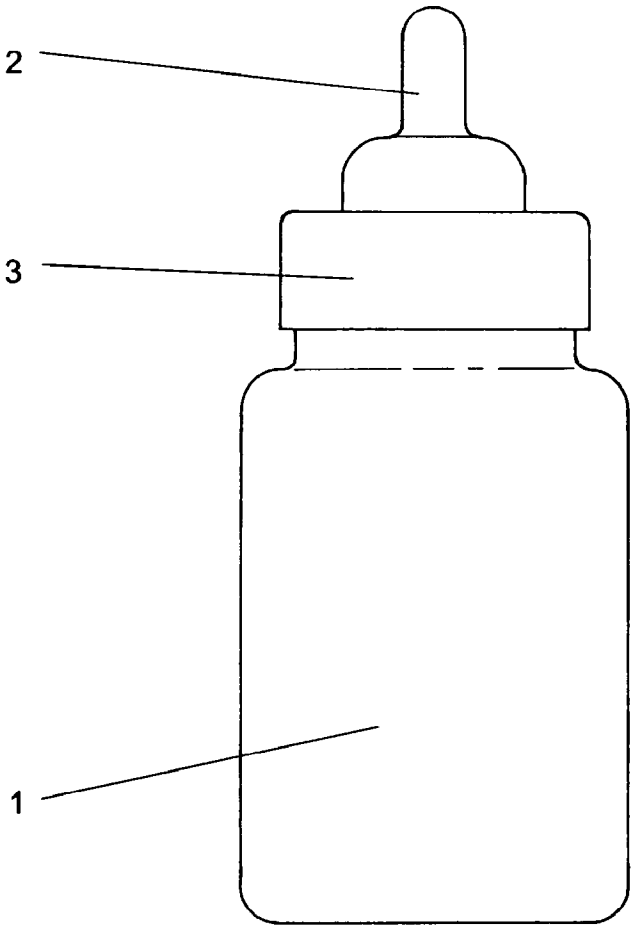
FIGS. 3 and 4 are lateral views of a general representation of a container and a baby bottle, on which we will show the idea of our invention.
Figure 3:
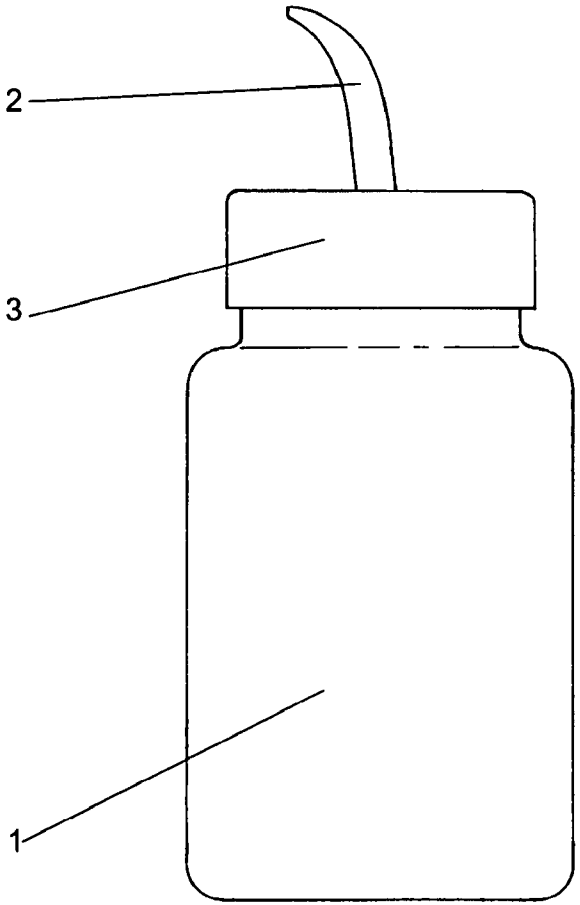

According to the illustrations indicated above and to their short description, more particularly in FIGS. 3, and 4, the mentioned air vent has been developed to be used in different types of containers; these can be baby bottles, flasks, and other similar containers (1), used to condition any type of liquid, which can easily flow through an upper spout/nipple (2) combined with any type of lid (3) to close the aforesaid flask (1).

The flask or container (1) may be made of any type of material, including plastics in general, glass, and metals, as well as hybrid materials combining cellulose layers with plastic materials.

In this invention, the upper spout/nipple (2) means any liquid outlet inside the flask or the container (1); this spout/nipple can also have the known characteristics of a baby bottle nipple or a hard plastic, or even metal spout like those used in olive oil tins, be they retractile or not. The ideal would be to use a non-drip spout in order to have a cost-effective and hygienic set.

Figure 5:
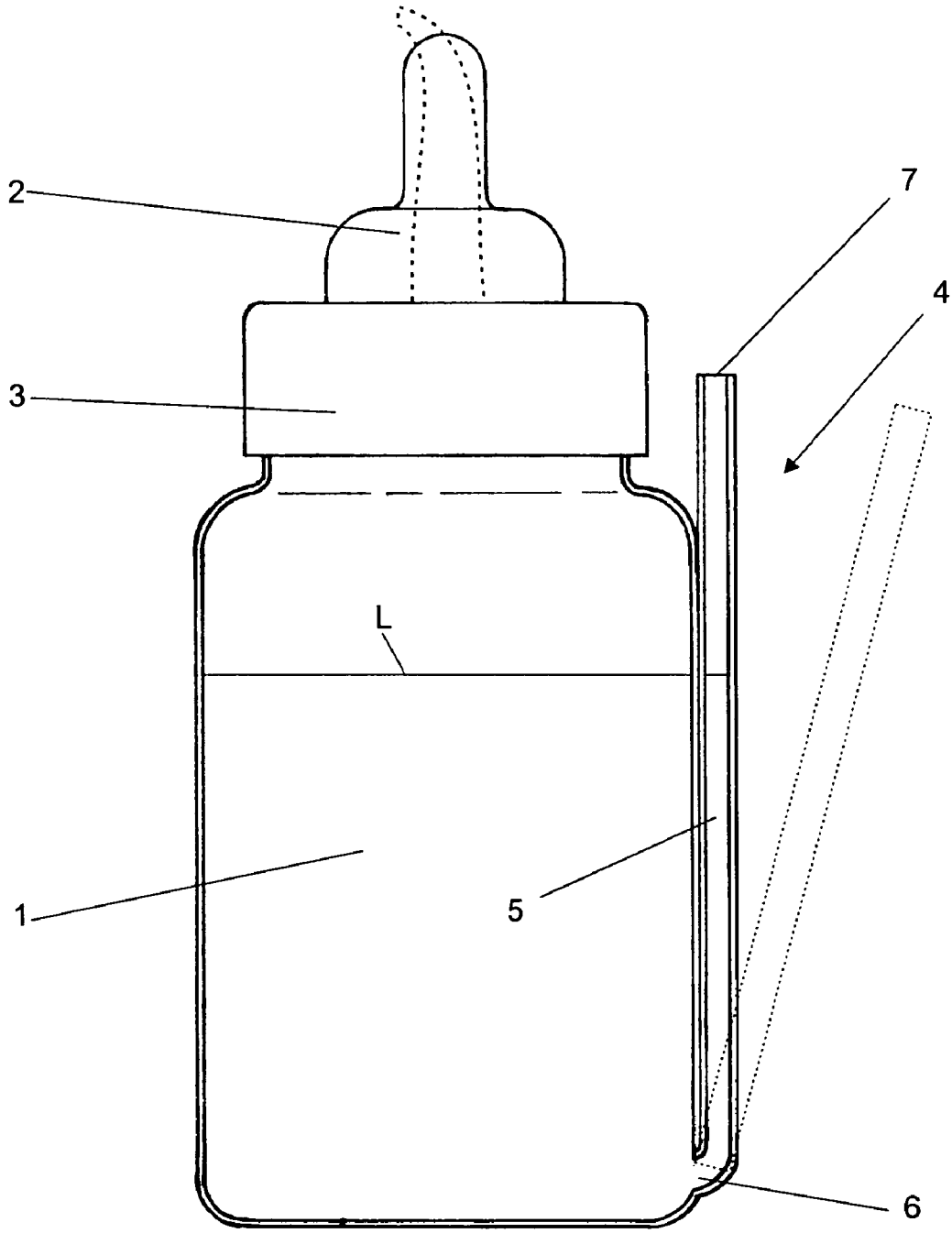
FIG. 5 illustrates a lateral view of a container and baby bottle with the present invention
Figure 6B:
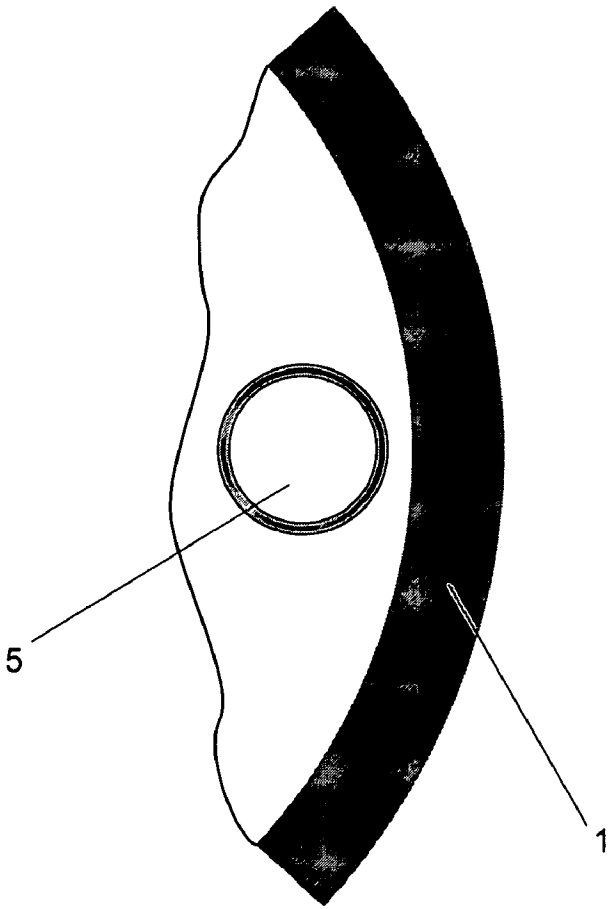
FIGS. 6A to 6D are cross-sections showing some of the positions of the air vent tube in relation to the container wall.
Figure 6A:
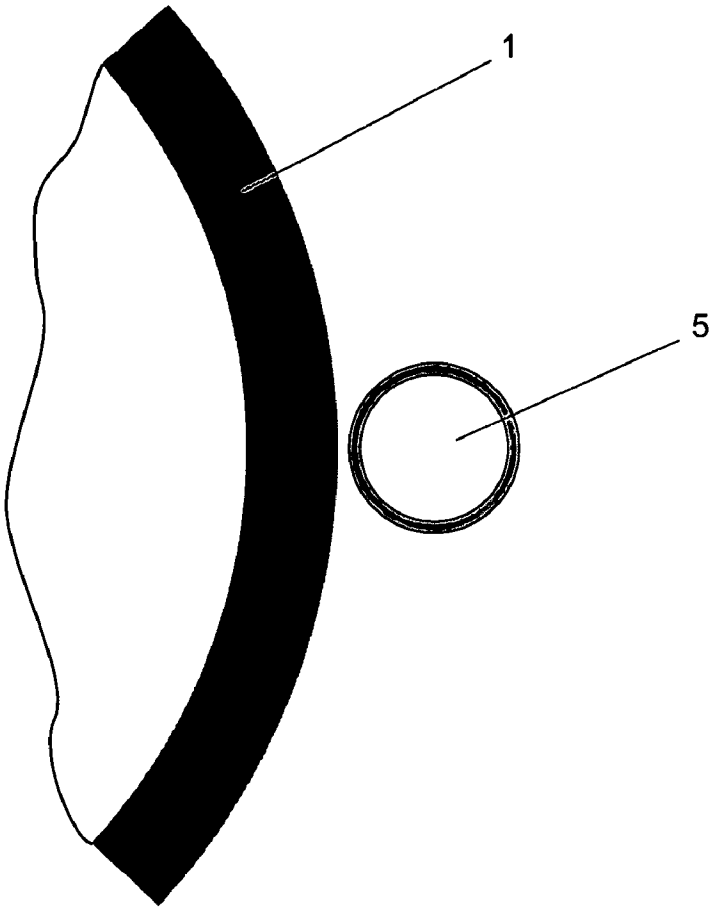
Figure 6D:
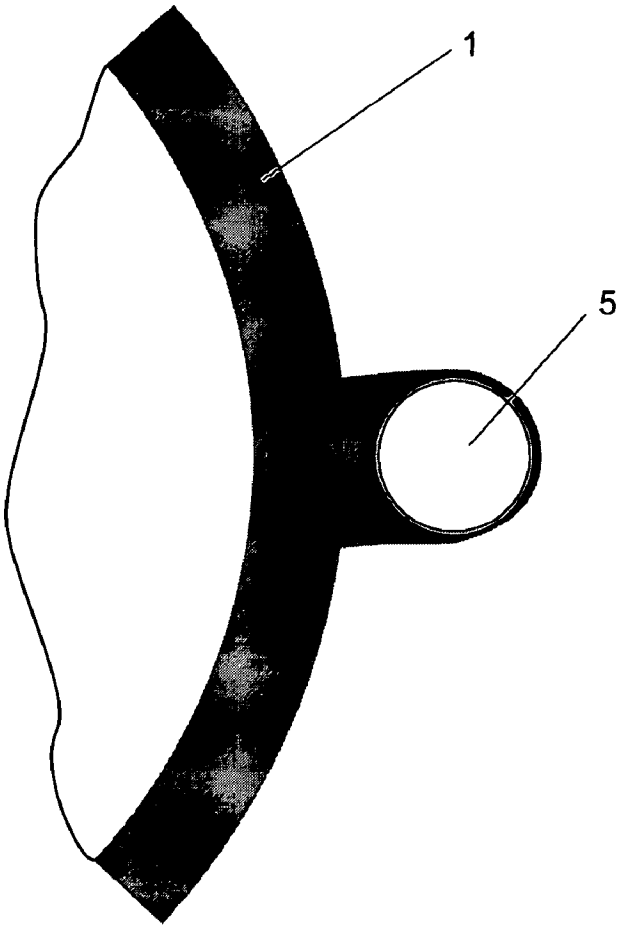
Figure 6C:
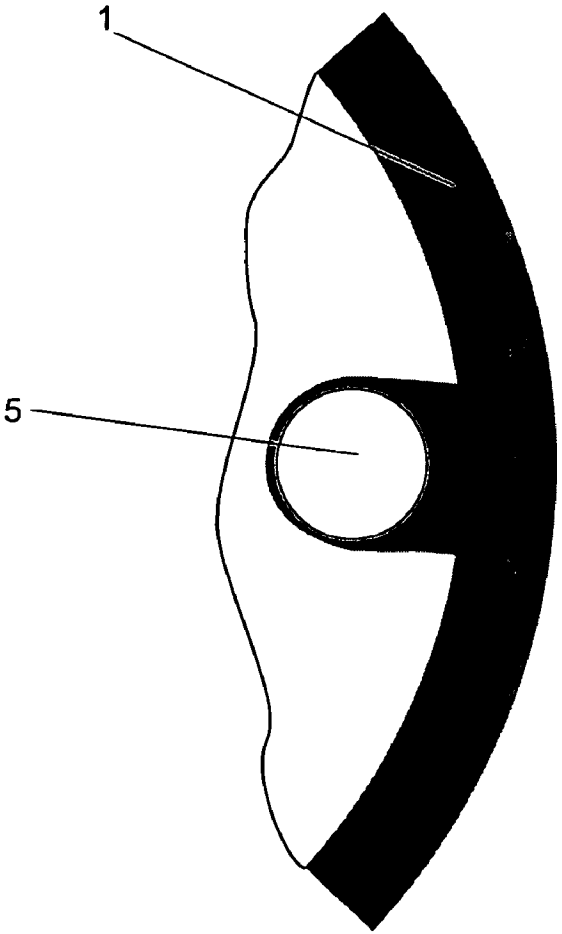

As per FIG. 5, the present air vent for liquid containers is characterized by the fact that is has an air vent (4) defined by a system of communicating vessels represented by a tube of appropriate diameter (5) placed vertically or obliquely to the axis of the container, whose lower end (6) is placed inside and at the bottom of the flask (1), while the upper end (7) is placed outside and at about the level of the lid (3), where the aforesaid end enables the external air inlet to go to the bottom of the flask or to the lower part (6) when the aforesaid flask (1) is sufficiently tilted for the liquid in the air vent duct or small tube (5) to go to the bottom of the container, enabling the external air to enter freely through the inlet (7) and go towards the bottom of the container (6) without going through the liquid (L) and stopping any vacuum formation at the bottom of the container (1), before the liquid is even poured out or sucked (baby bottle).

Concerning FIGS. 6A to 6D, the air vent duct or tube (5) can be place inside (in several positions) or outside the flask or the container body (1); this tube (5) can also be a separate part or one fixed to the flask (1) though in any other case, the lower ends (6) and upper ends (7) are placed likewise.

Figure 7:
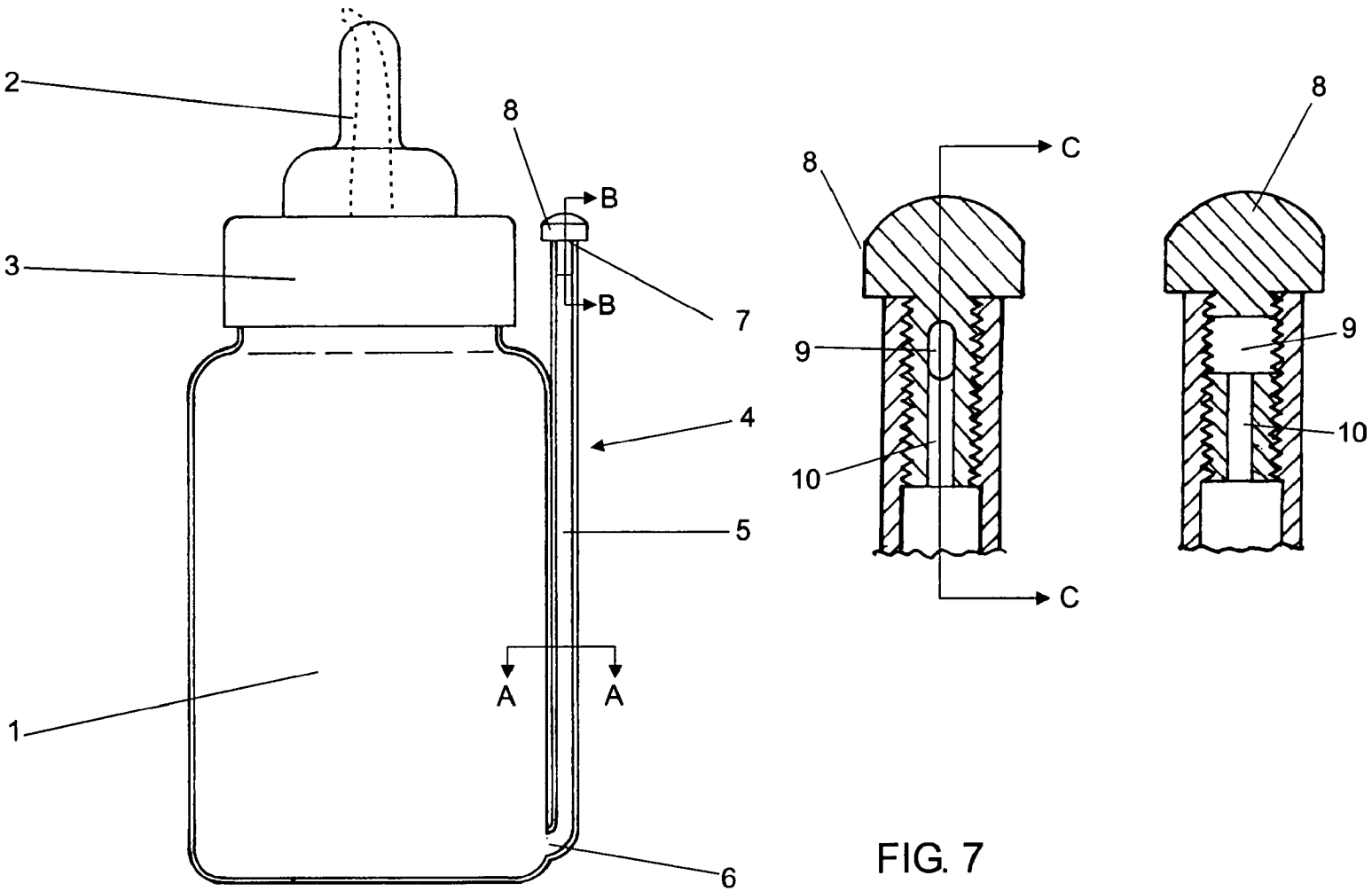
FIG. 7 is a lateral view of a container or baby bottle showing that the air inlet may be completely open or have a special stopper or plug, which are shown in amplified cross-sections.

Still, concerning FIG. 7, the upper end of the air inlet (7) may be kept completely open or have a stopper (8), preferably one that can be screwed with a transversal hole (9) and a longitudinal hole (10), characterizing the total or gradual opening of the air inlet in reference hereto (7).

Figure 8:
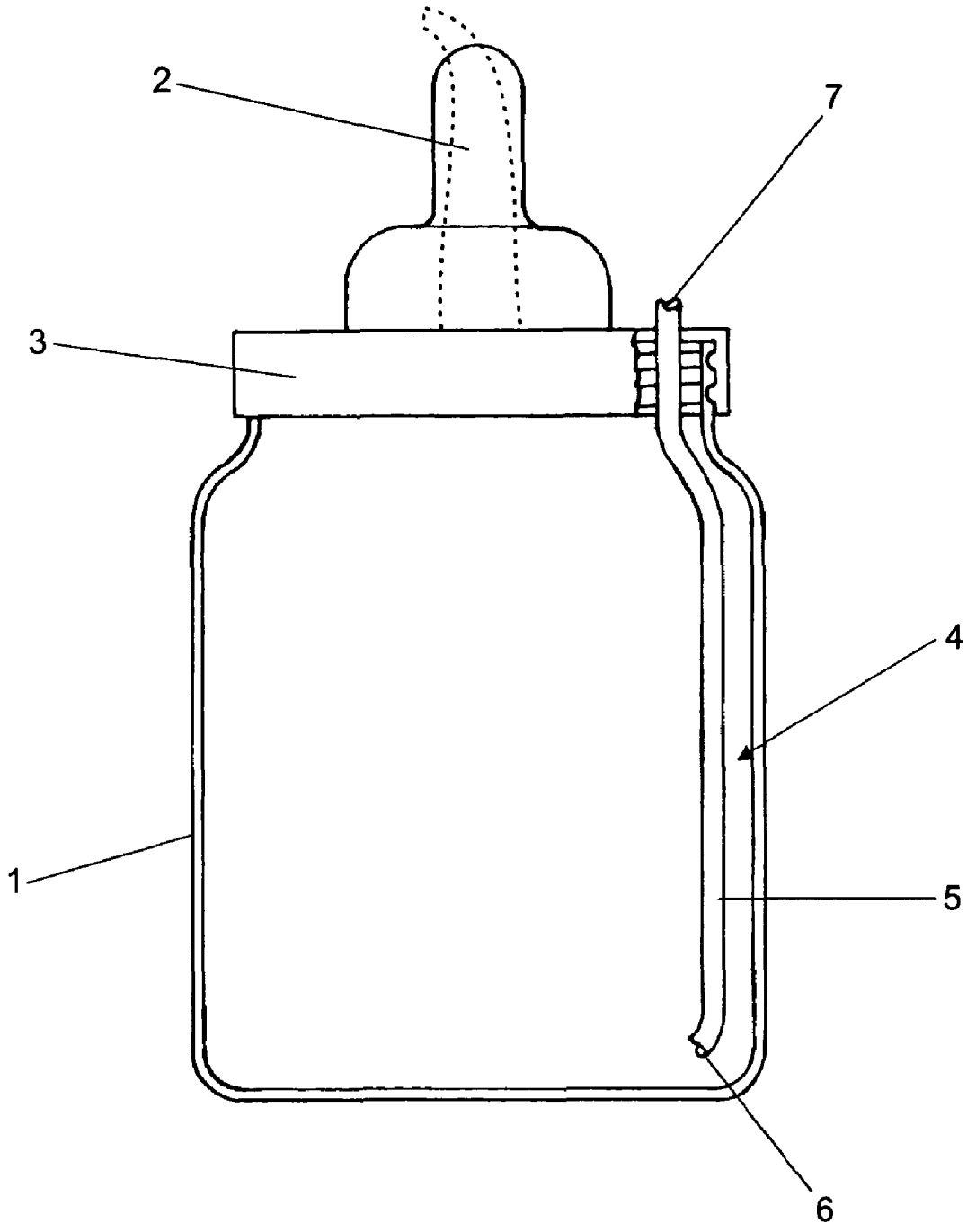
FIG. 8 is a sectional view of a container or baby bottle, where the air vent tube is coupled to the lid.

As per FIG. 8, the air vent system (4) can be coupled to a lid (3); in that case, the duct (5) has also its lower end placed at the inside of the flask (1), while its upper end is above the aforesaid lid (3), where is properly fixed and may also have, or not, a stopper (8).

Figure 9:
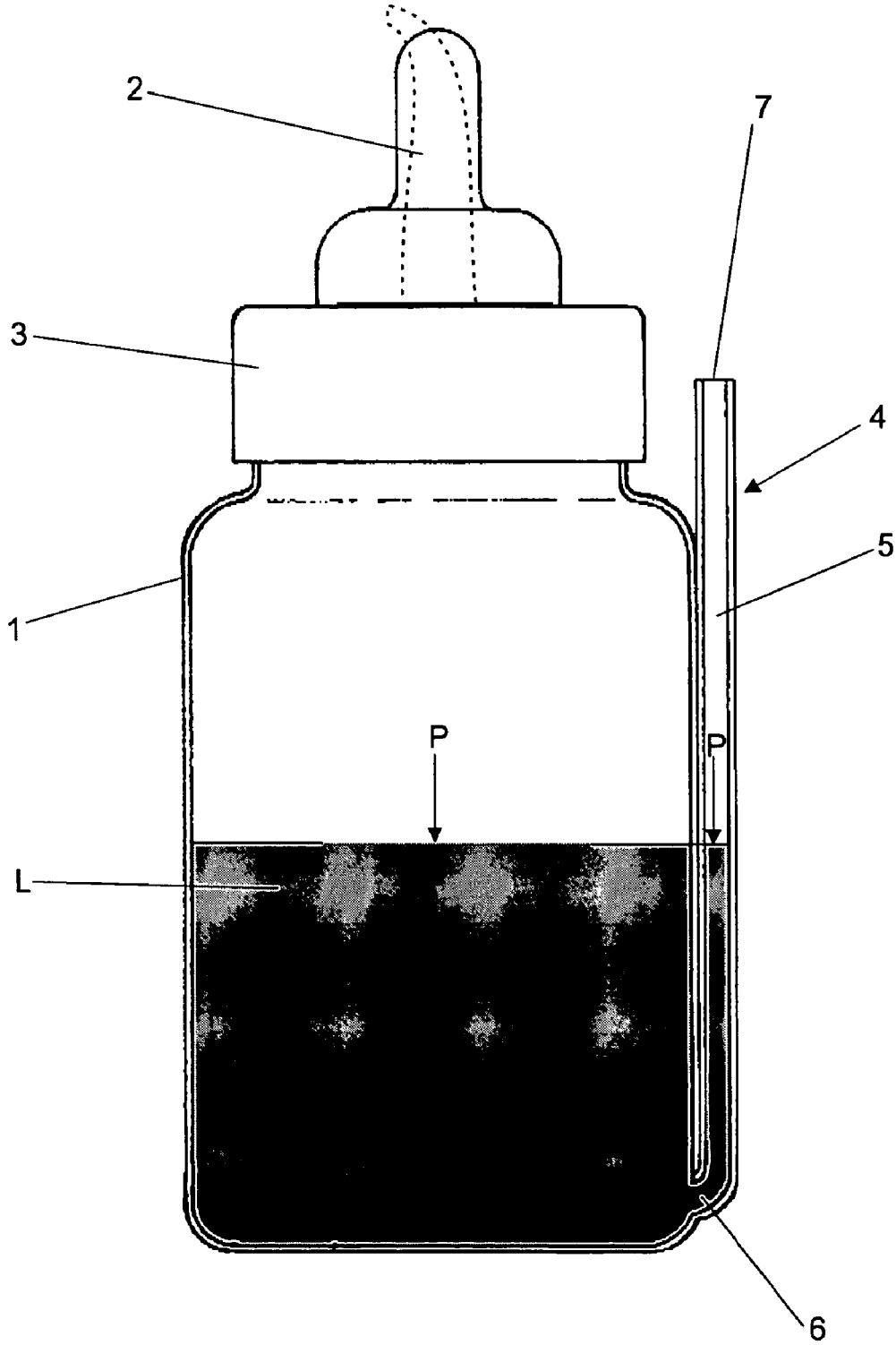
FIGS. 9 to 15 are lateral sections of a container or baby bottle showing the application of the principle of communicating vessels.
Figure 10:
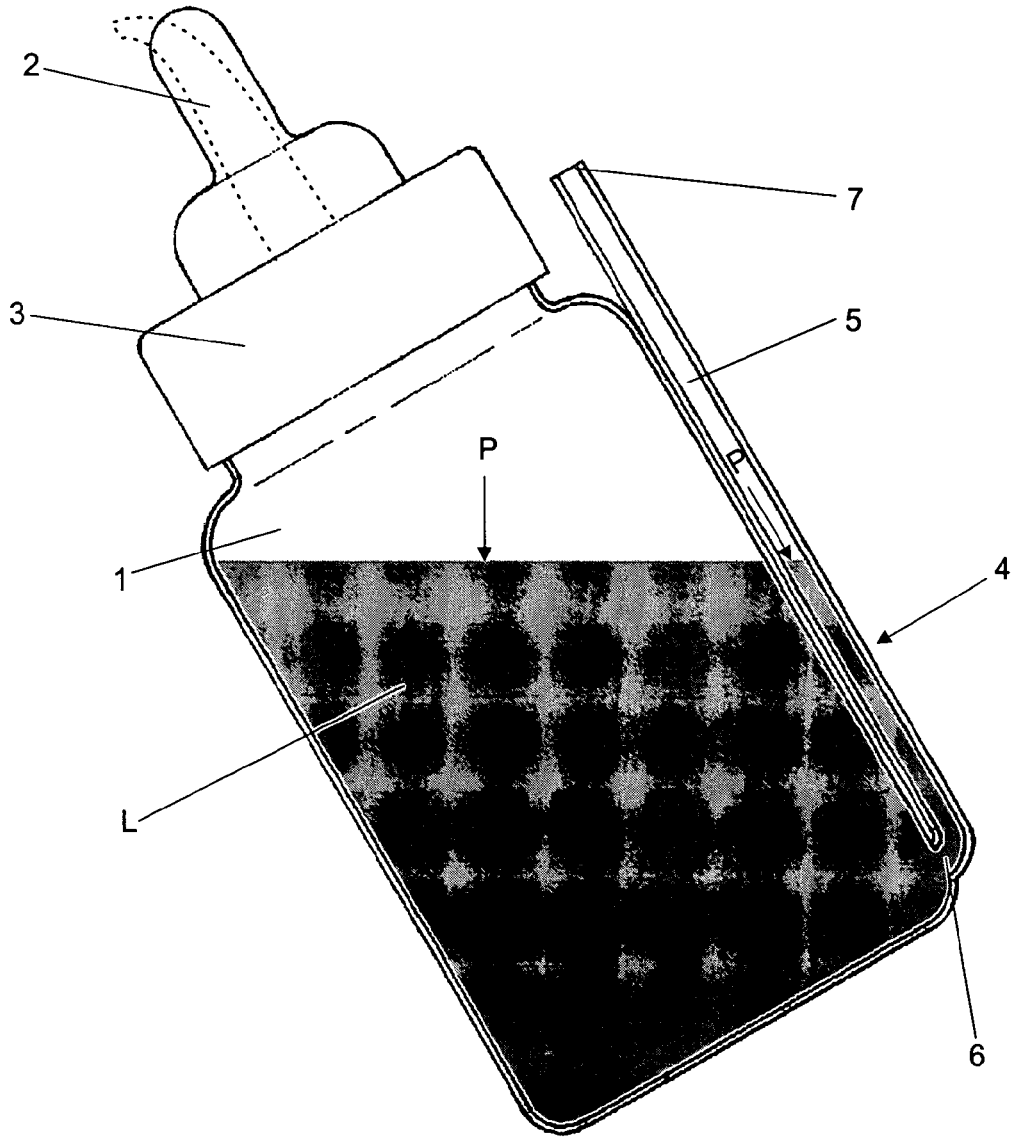
Figure 11:
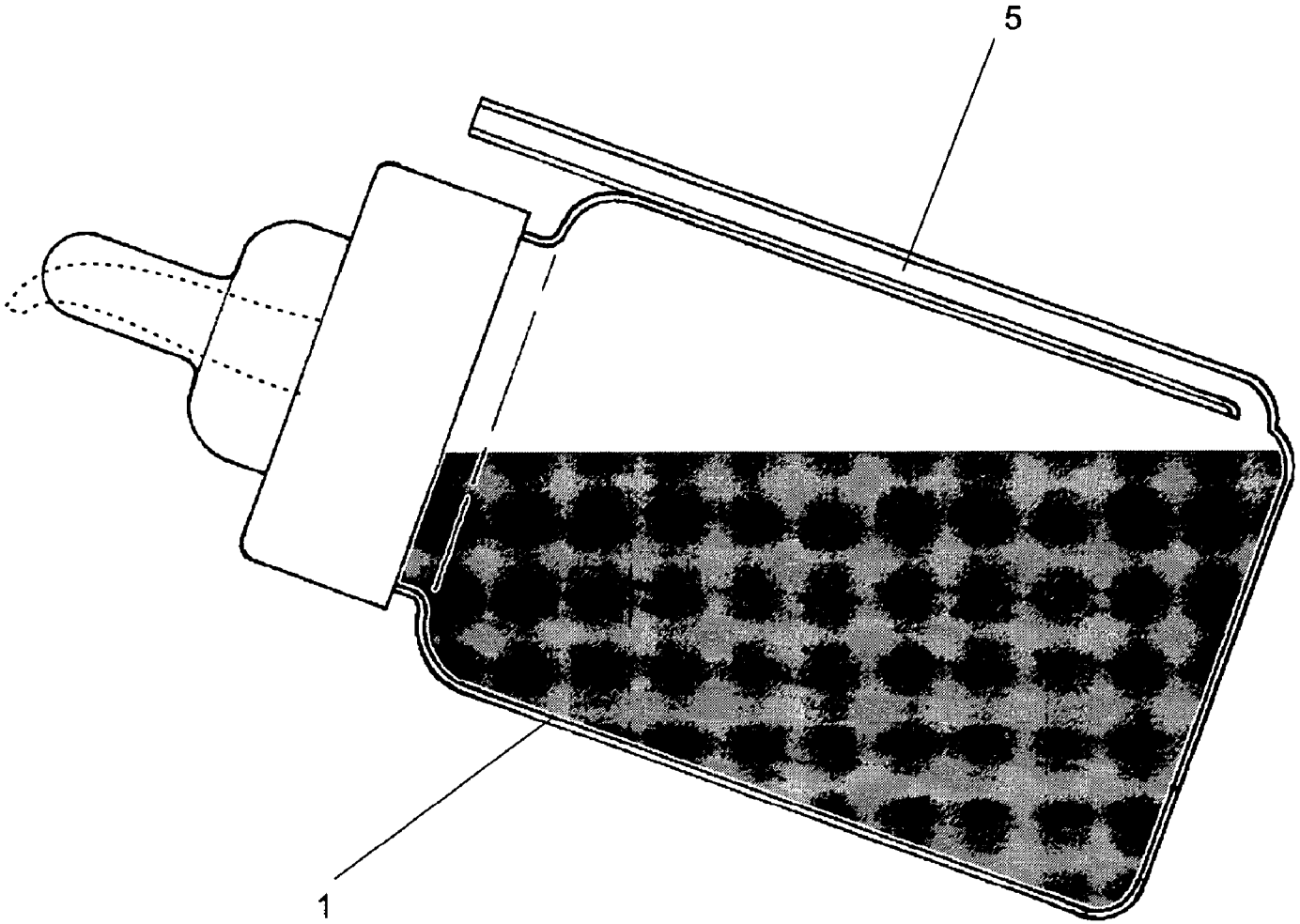
Figure 12:
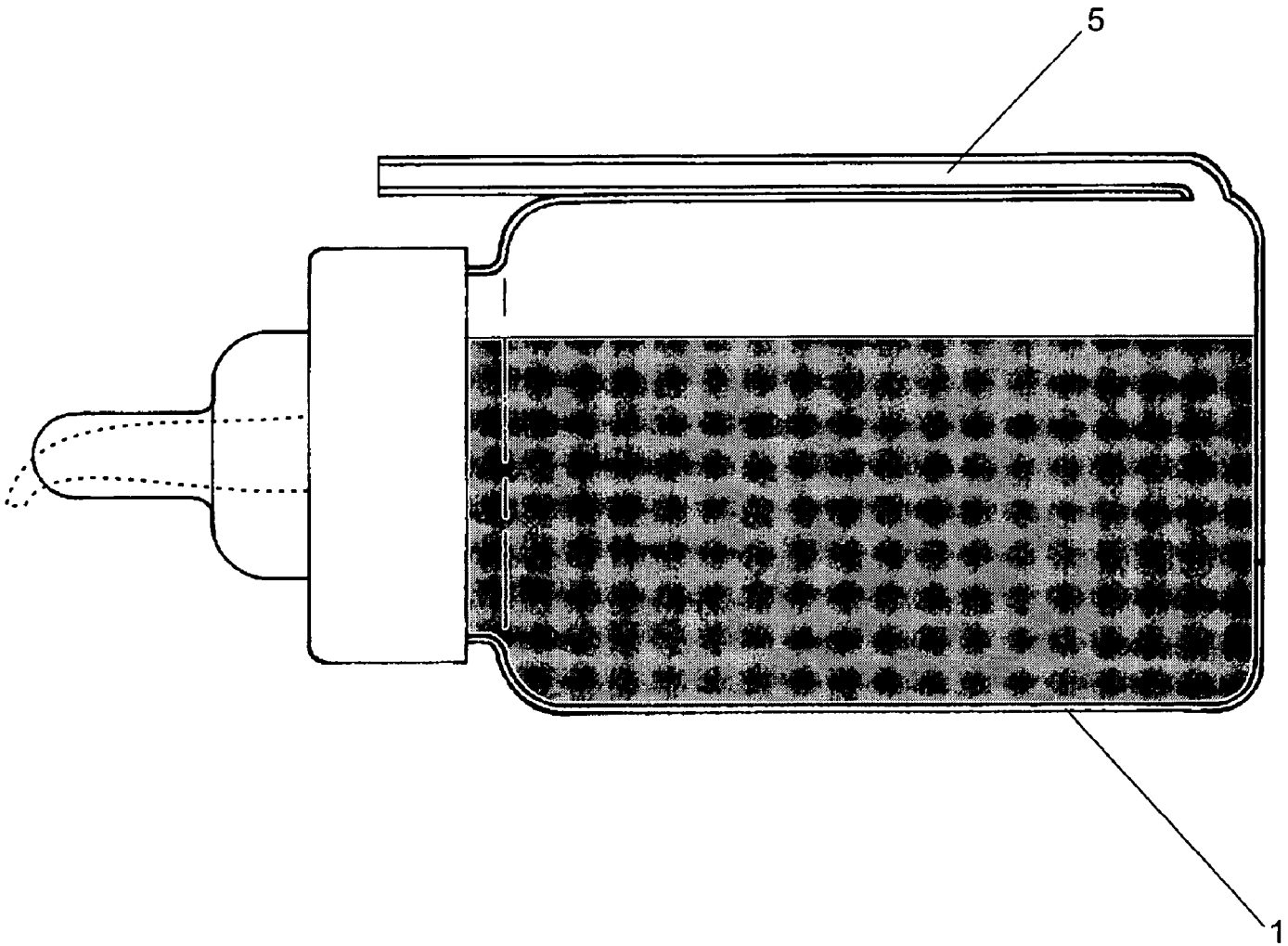
Figure 13:
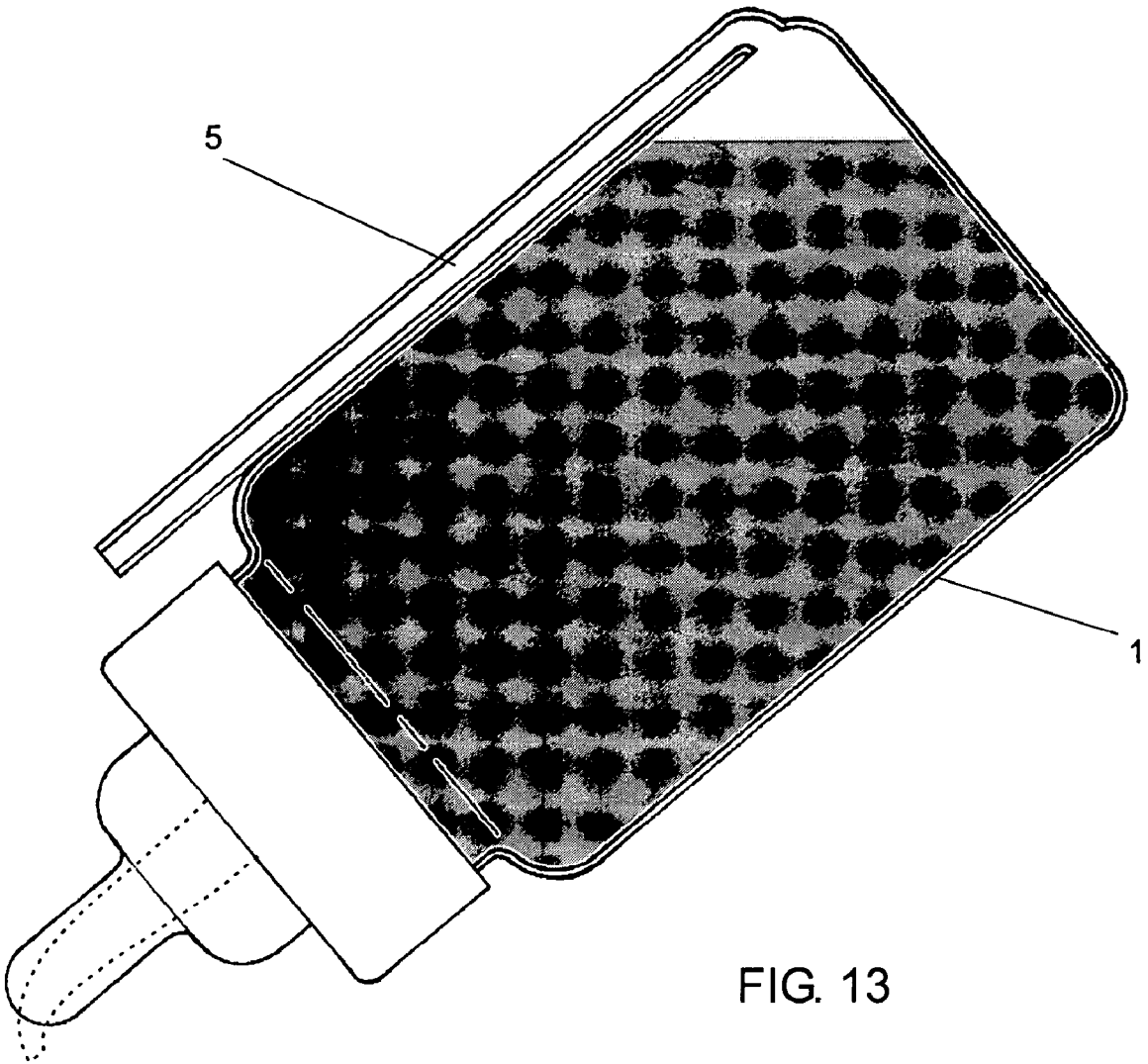

Therefore, the mentioned air vent is based on communicating vessels, that is to say, as per FIG. 9, there are actually two levels of liquid: one inside the flask or container (1) and the other inside the air vent tube (5), as both are adjacent communicating vessels. So, independently of the position of the flask/duct (1-5) the level of both compartments and vessels is always the same provided that the pressure (P) on these levels is the same too. (FIG. 1A, B, C, and D).

Still, concerning FIG. 9, the air vent (4) can have an upper end (7) equipped with an accessory or means of extension, or the very tube (5) may be used as a means of sucking the contents of the container (1). In that case, the duct (5) or a tube added to it then works as a drinking straw, whose use has many advantages in some situations, as it enables the baby to suck without needing to use its hands for instance.

Because of this, as shown on FIGS. 10, 11, 12, and 13, when the set is tilted and the pressures are maintained the same (atmospheric pressure) the levels of the communicating vessels (1-5) are consequently the same so that the upper vessel, that is the air vent duct or tube (5), will be emptied of any liquid when the vessels are almost horizontal (FIG. 11) The horizontal position (FIG. 12) ensures that the upper vessel does not have any liquid inside. The horizontal position is reached before the tilted position, that is to say, the spout/nipple (2) turned down, that is when the outflow of the liquid starts or when the baby starts sucking.

Therefore, when starting pouring or sucking, the external air is already at the bottom of the container (FIG. 13) without needing to form any vacuum at the beginning or during the outflow (sucking). Moreover, leakage cannot possibly occur trough the air vent tube since there is no liquid left in it. Thus, while a volume of liquid is poured or sucked, a volume of external air is sent to the bottom of the container. In the case of baby bottles, the characteristics above make them totally colic-free and are good for lazy babies who do not want to make much effort to suck and the other ones who cannot make much effort to suck.

For this to occur, the container must be designed (pouring nipple position, container volume (1), tube diameter and volume (5), liquid characteristics, lower end (6), etc.), in such a way that the liquid in the air vent tube (5) must be at the bottom of the container (1) even before starting to pour or sucked the liquid. This will only occur if the pressures are maintained the same (atmospheric pressure, or any other) at the surface of the liquid inside the container (1) and at the surface of the liquid inside the air vent tube (5) until all the liquid of the tube goes to the bottom of the container. This equal pressure is necessary for the principle of communicating vessels to occur. If not, part of the liquid that was in the tube will not go to the bottom of the container (FIG. 14) and will only go to the bottom of the container when starting pouring because of the initial vacuum that forms at the bottom of the container. This occurs with the current containers available in the market or not specifically designed, that use air vent as proposed in this invention.

Figure 14:
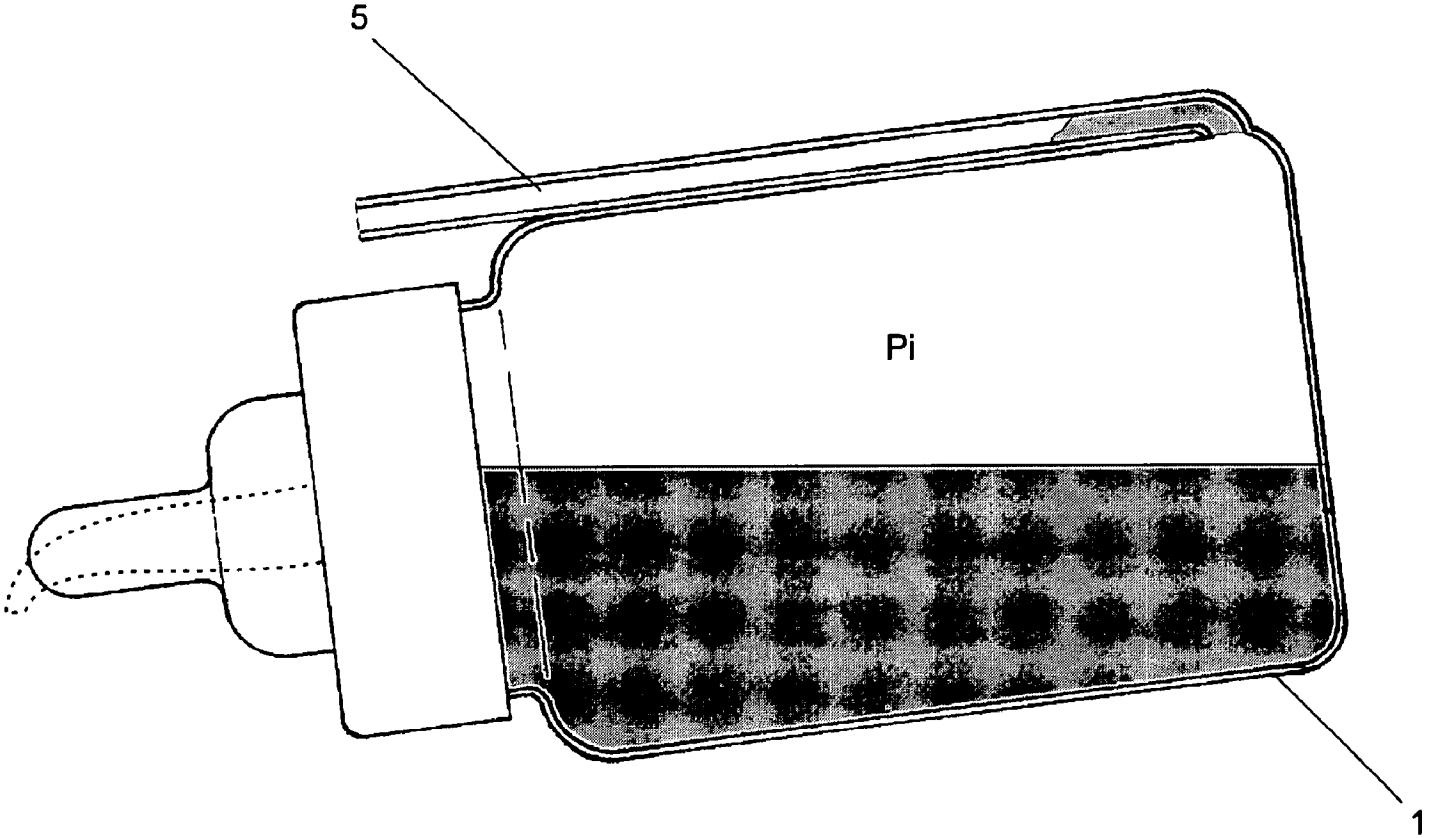

As shown on FIG. 14, the liquid in the container obstructs the outflow and stops the atmospheric pressure from remaining the same before all the liquid in the tube (5) goes to the bottom of the container. In that case, the pressure of the internal air (Pi) stops the liquid in the tube from continuing to the bottom of the container. It will only go to the bottom of the container when starting to pour or sucked the liquid inside the container, thus creating the initial vacuum, that is, reducing the pressure (Pi). Just after the beginning of pouring or sucking the liquid, the external air goes straight to the bottom of the container and will not go through the liquid and there will not be vacuum formation during the pouring or sucking.

The above explanation is what happens with some usual containers, not specifically designed, when an air vent tube, as proposed in this work, is installed on them, and having a tiny orifice as discharge hole and is full of liquid. In this case the principle of communication vessel is achieved until the beginning of the discharge or suction, when the pressure equalization ceases. The amount of liquid that remained in the air vent tube will go down to the container bottom, to replace the discharged liquid, Then the external air goes down to the container bottom, without crossing the liquid and there will be not vacuum during the liquid outlet. As the level goes down the principle of communicating vessels is easily achieved.

Therefore, the mere tilting of any container is not enough for the liquid in the tube to go to the bottom of the container, before starting to pour. This will only occur if the container has been designed properly or for some type of usual containers, so as to allow for the principle of communicating vessels.

As already mentioned, the air vent inlet may be regulated or controlled through the stopper (8) or through any other device and, thus, such an adjustment control also the liquid discharge through the spout or nipple (2). This feature is practical depending on how the set is applied, mainly when the flask (1) is used as a serving device for seasoning, eatable oils and/or other fluid flavourings, as well as other applications.

Figure 15:
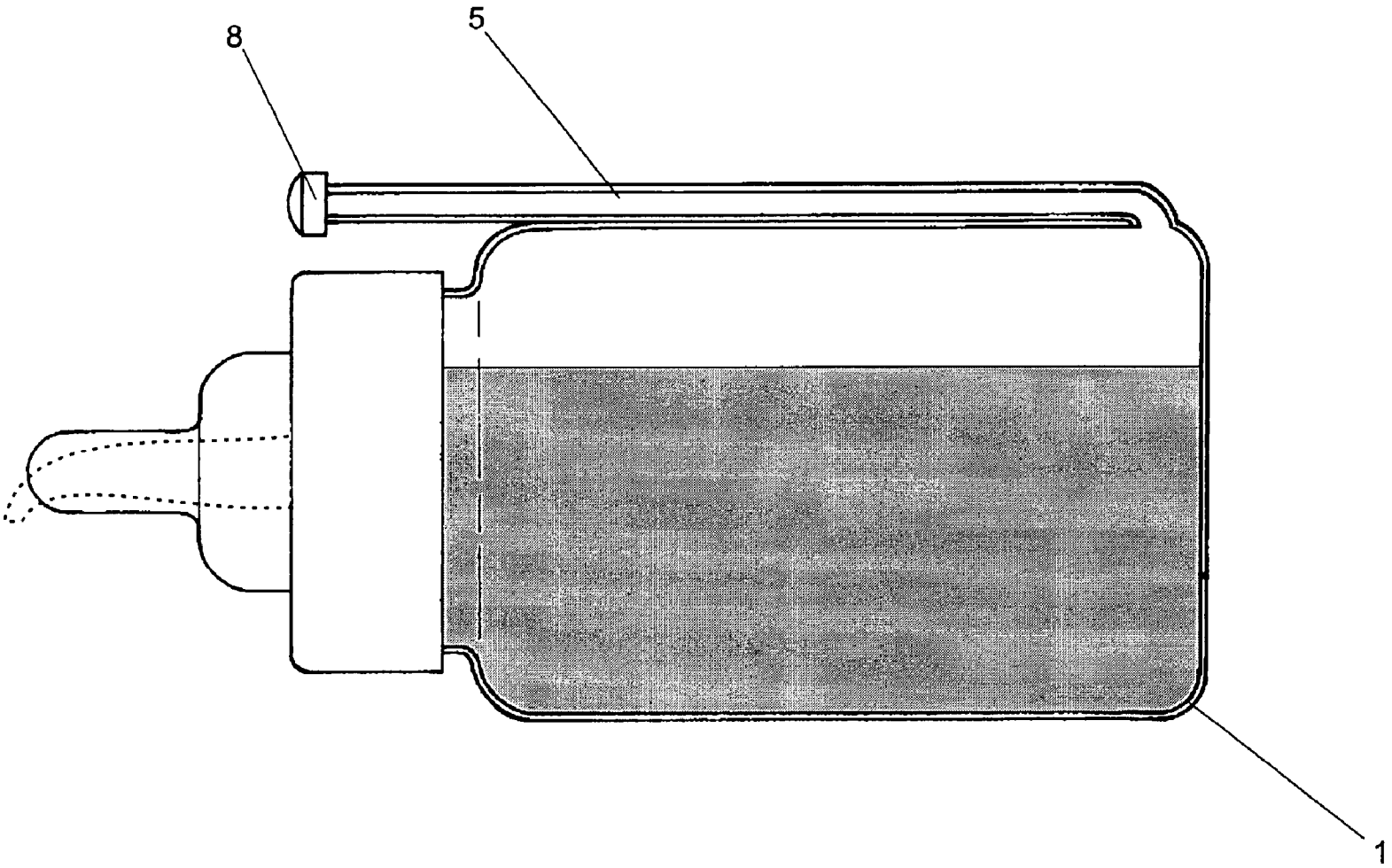

The stopper (8) is also used closed when sudden movement are required (shaking) to mix liquids or liquids with powders (formula and chocolate drinks) in baby bottles for instance. It must be closed before pouring the liquid in the container. After the liquid is poured in the container, with the stopper (8) closed, when placing the container horizontally (FIG. 15), no liquid will be left in the air vent tube and no liquid inside the container will possibly flow into the tube. The stopper (8) may be opened in that position so that the external air goes directly to the bottom of the container, before starting to pour or sucked the liquid in the container.

Furthermore, as per FIGS. 10, 11, 12, and 13, it is clear that when the flask (1) is used, may it be during the discharge or when the container or the baby bottle is placed vertically, with the nipple downwards, there is no danger of leakage through the air vent tube, since in both cases, there is no liquid in the air vent rube, be the air vent initially opened or initially closed.

As already stated, when the container is placed horizontally with the air vent tube looking upwards, no liquid will be left in the air vent tube; and so, there will be no danger of leakage. In the case of baby bottles, this position corresponds to when the baby is lying. In that case, you must consider the relative position between the nipple and the air vent tube, since the tube must always be higher.

It may be necessary to stop the process of discharge or sucking of the liquid to reinitiate it straight afterwards. In those cases, the procedure usually is exactly the same as when the air vent tube is open, and it is not necessary to close the external air inlet (stopper) again. This will only be necessary when handling the container and sudden movements are made.

As an alternative construction for the stopper (8), you may place it in any other position on the duct (5), that is, from the upper end of air intake (7) to the lower end (6); in that case, the stopper (8) must be closed whenever you want to interrupt discharge or consumption and when the level of the liquid is above the position of the stopper (8). In the ultimate case of the stopper (8) closing the lower end (6) directly, you may require closing the stopper (8) every time you need to interrupt discharge or consumption; if not, liquid will leak from the aforesaid stopper (8). This alternative construction is only recommended when there is no way of interrupting discharge or consumption. It is only efficient if the opening and closure of the air vent (4) is made to be automatic instead of the stopper (8), as it is explained below. This implies a higher manufacturing cost. Therefore, the solution for most cases is to place a stopper (8) or to make the opening and closure of the upper end to be automatic (7), that is to say, upwards.

Figure 16:
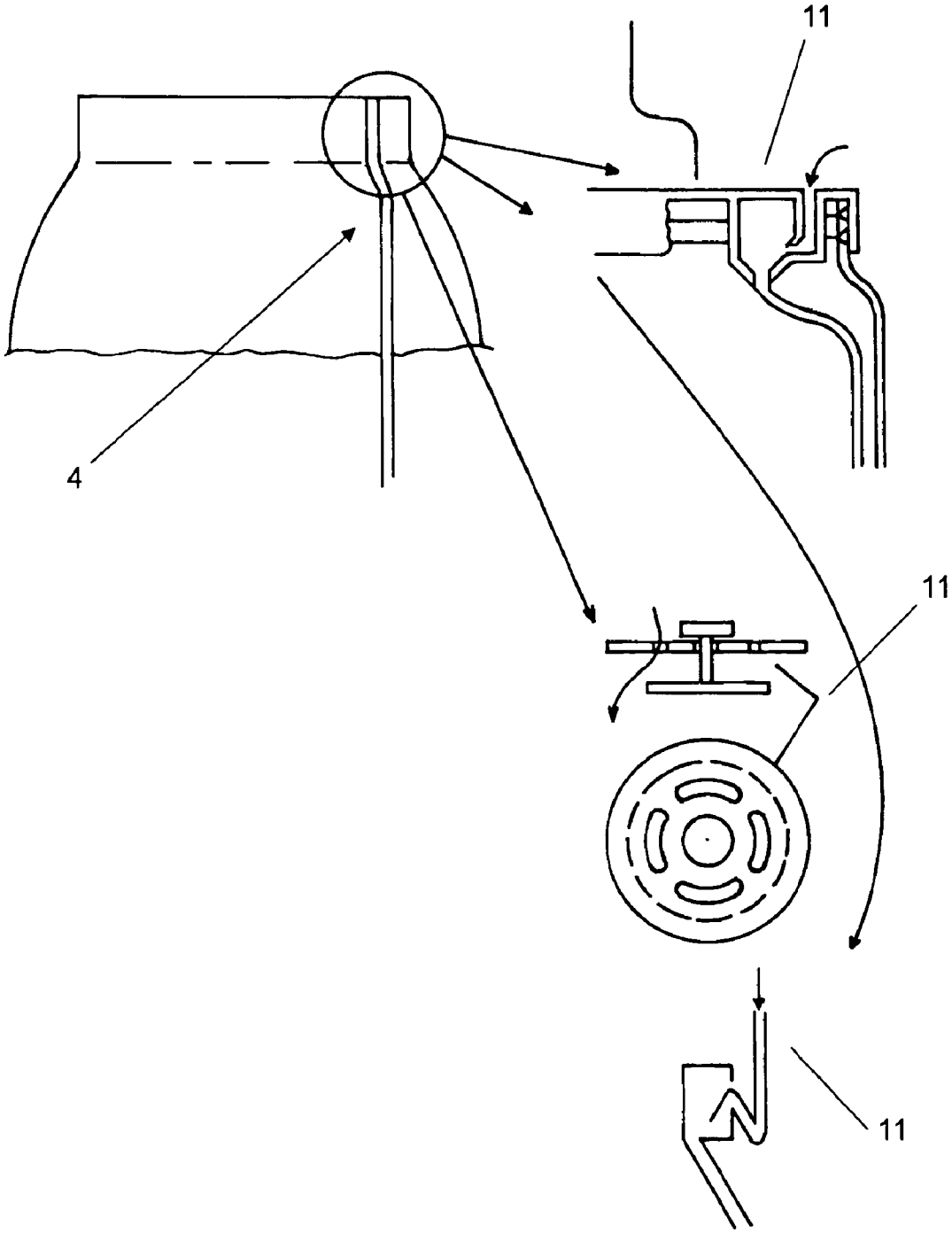
FIG. 16 illustrates the several devices that may be used at the air inlet to control the amount of air and avoid leakage.

Concerning FIG. 7, the air vent (4) may have its closing and opening system automated; and so, instead of an stopper (8), as shown on FIG. 16, the air inlet is changed to work together with specific devices (11) as micro check valves, dosimeters to control the air intake flow, labyrinths an/or others so that the air inlet is closed automatically to avoid any liquid from flowing outwards like when jerks are made. Nevertheless, you may also automate the functioning system in cases where no jerks occur.

Figure 17:
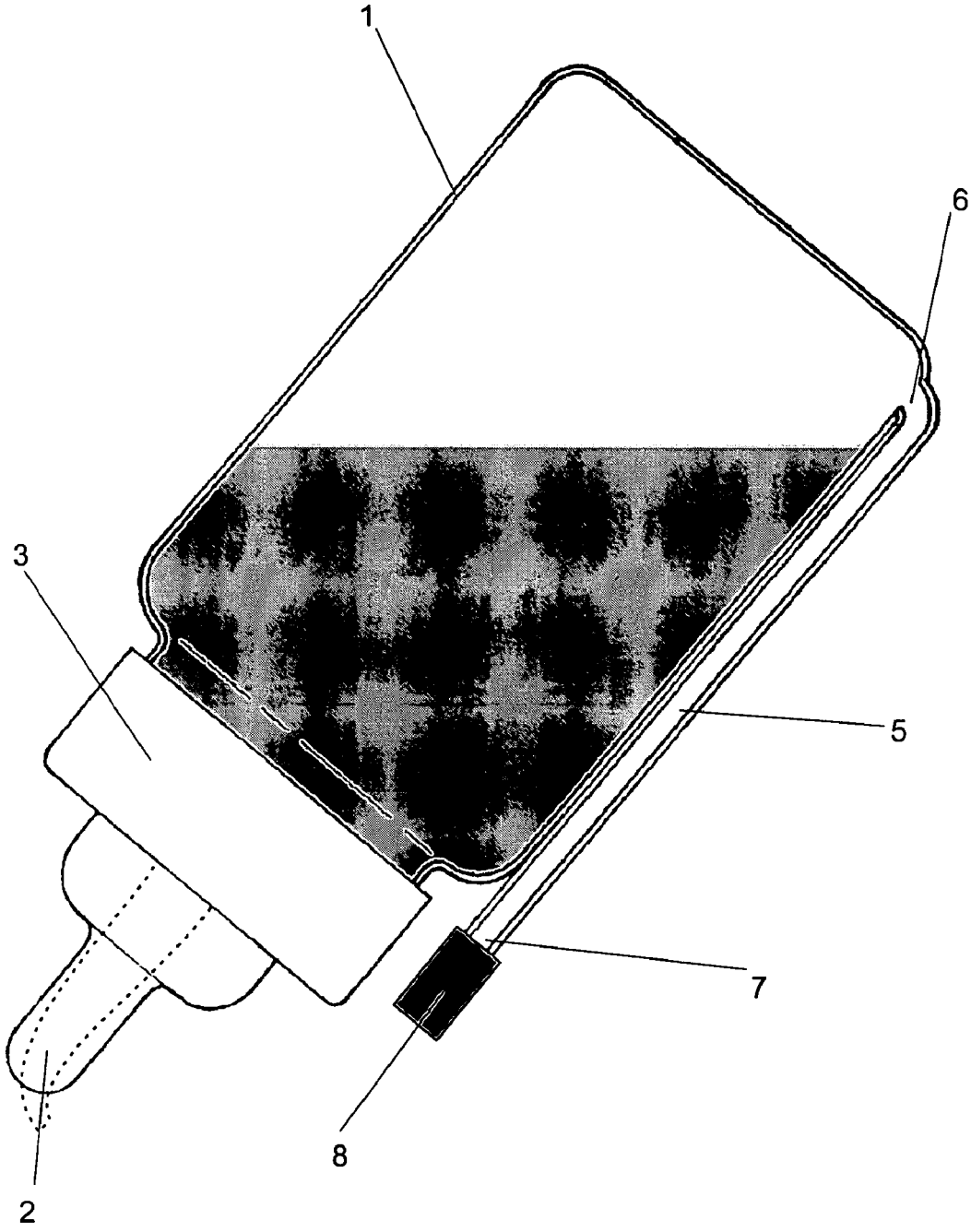
FIG. 17 is a lateral view showing a particular use of the air vent tube.

All the consideration previously mentioned for the handling and use of the container, be it a baby bottle or not, have been made considering that the air vent was to be always higher when tilting the container. Possible uses and applications may arise whereby for given reasons the air vent must be placed on the sides or at the lower part of the container, as shown on FIG. 17, in which you see a particular way of using the container so that the air vent remains lower when the container is turned down. In that case, the air vent is maintained closed until its internal end (6) is above the level of the liquid; only then is the air vent opened to take external air in. In that case, it is important to consider the dimensions of the container as well as the relation between its volume and the volume of the liquid placed inside the container.

Finally, in brief, using the illustrations provided by FIGS. 1A, B, C, and D, which show how the liquid reacts when used in different ways, that is to say, as mentioned before, the set is based on the principle of communicating vessels (1-5). The levels of the liquid in two adjacent vessels are identical provided that the pressure on these levels is the same.

For this reason, when tilting the container (1-5) and maintaining equal pressures (Pa), atmospheric pressure generally, on the levels of both vessels, these levels remain the same and constant horizontally so that the vessel that is higher will have no liquid whatsoever left when both vessels are horizontal (FIG. 1C). Horizontally, the upper vessel is guarantied to have no liquid left inside (FIG. 1D). The horizontal position is reached before the tilted position (spout or nipple downwards) that is in the instance of discharge or when the baby starts sucking. Therefore, on pouring or sucking, the external air will already start going down to the bottom of the container without the need for the formation of a vacuum at the beginning or during discharge (sucking). No possible leakage through the air vent tube (5) will occur either.

For this to occur, the container design, which must take into account the characteristics of the liquid (viscosity, capillarity, etc.), the position of the pouring spout or nipple, the easy cleaning, etc. must also contribute for all the liquid in the air vent tube (5) to go straight to the bottom of the container (1) before even starting pouring. This will only occur if the pressures are maintained the same (atmospheric pressure or any other identical pressure) at the surface of the liquid in the air vent tube (5) and at the surface of the liquid inside the container body (1), until the liquid in the air vent tube (5) goes completely to the bottom of the container (1). This equal pressure is necessary for the principle of communicating vessels to occur.

As for FIGS. 2A, B, and C (balanced pressures) when the pressure on the liquid in the air vent tube (5) is supposedly higher than on the liquid in the container body, the levels will not be identical and the liquid may not flow into the air vent tube when pouring liquid in the main body of the container (1). This functioning condition occurs when the stopper (8) closes the air vent tube (5). In that case, the air retained in the closed air vent tube (5) will stop the levels from being equal since the pressure created in the air vent tube is higher than the atmospheric pressure. On tilting the container, the liquid will not flow in any possible way through the air vent tube (5) and on reaching the horizontal position (FIG. 15) the tube (5) will be opened when the stopper (8) is removed, thereby enabling the external air to go to the bottom of the container without requiring the formation of vacuum at the beginning or during discharge (sucking); and, just like in the case of an open air vent tube, no leakage will occur from the air vent tube.

Therefore, the handling of the container (1) may be done in two different ways, with the air vent open or closed.

When the tube (5) is open (FIG. 1A) while pouring the liquid into the container, the level of the liquid inside the air vent tube will be at the same level as that of the liquid inside the container due to the principle of communicating vessels. In those conditions, the set cannot be shaken as this may cause leakage through the air vent (4) which is closed thanks to the stopper (8) before filling up the container so as to eliminate this problem; however, before pouring the liquid or before sucking, when the container is placed horizontally (FIG. 15), the stopper will have to be left open for the inlet of external air straight to the bottom of the container, thereby eliminating any vacuum completely.

On the other hand, if the tube (5) is closed (FIG. 2A), and the container is filled up with liquid, the situation is practically the same; in other words, the liquid does not fill the second vessel represented by the tube (5), since some amount of air is locked in it, where the balance of pressures is established as previously described.

This does not interfere in the functioning of the set, which, in that case, may be shaken to mix the liquids, or any specific preparation as when milk is served with powder chocolate. The shaking of the container may be repeated whenever the stopper (8) is closed. On reaching the horizontal position (FIG. 15), the aforesaid stopper (8) may be opened since there is no liquid in the tube (5) nor is there a risk of liquid flowing out from it. This will enable the air to go to the bottom of the container before starting pouring or consuming; thereby avoiding the formation of a vacuum; and, the air will not go through the liquid. Consequently, a continuous and regular outflow will occur right from the start without risking any leakage through the air vent.

In both above cases of communicating vessels or balanced pressures, while a volume of liquid poured, an equivalent volume of external air is also instantly sent down to the bottom of the container. In the case of baby bottles, these characteristics make the bottle completely colic-free and are good for lazy babies who do not want to make much effort to suck. and the other ones who cannot make much effort to suck.

In practice, containers will mostly be designed with a stopper (8) since the air vent tube (5) must be closed during the transport of a container containing liquid.

Figure 19:
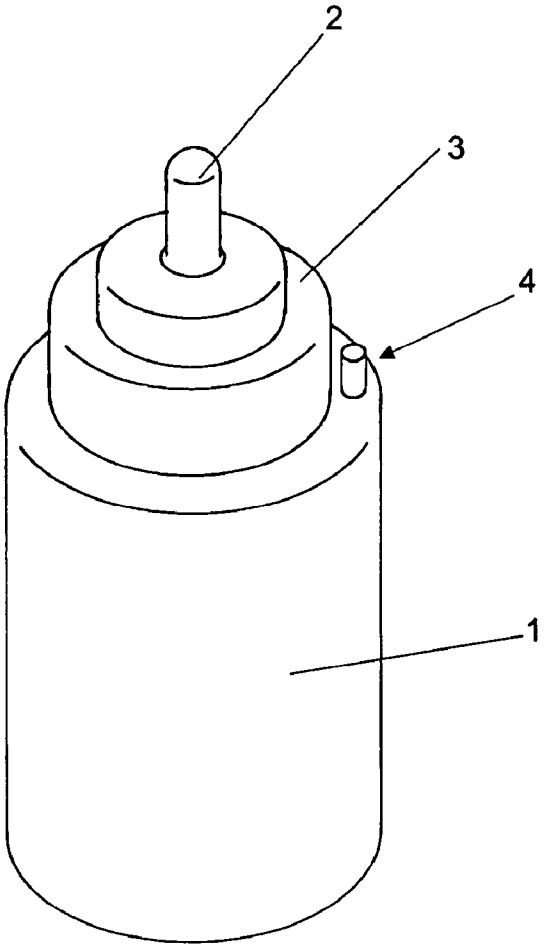
FIG. 19 shows a perspective of the container illustrated in the previous Figure.
Figure 18:
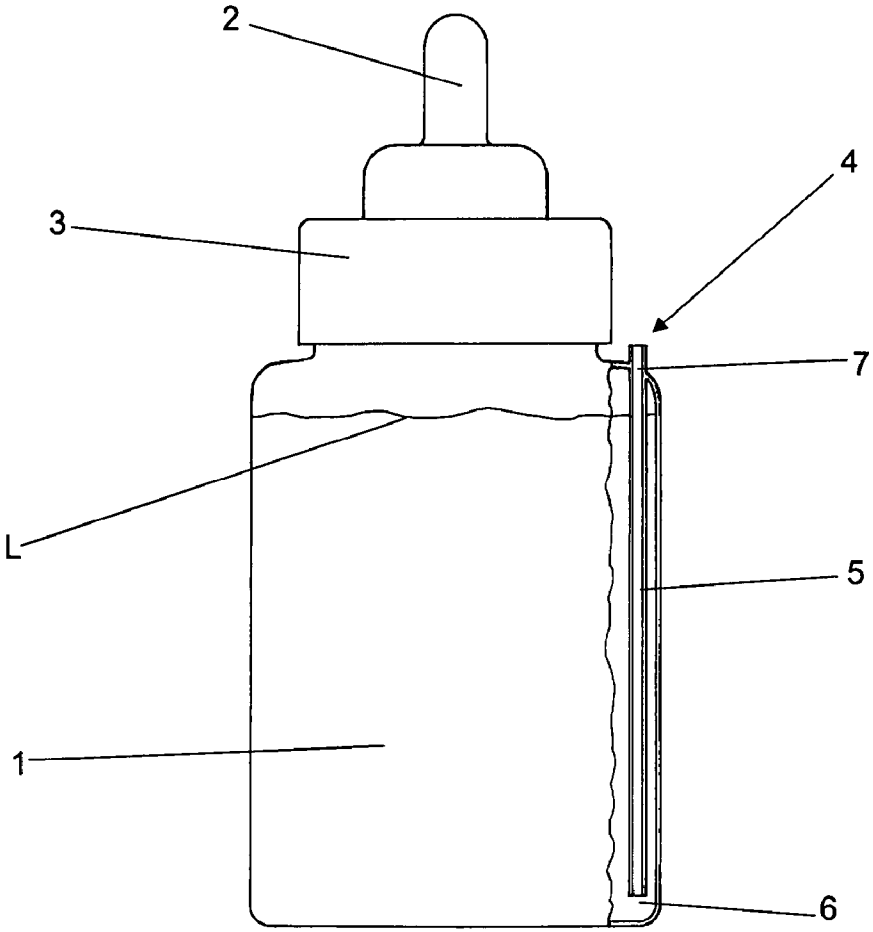
FIG. 18 is a lateral view enhancing the location of the air vent tube inside the container or baby bottle.

The FIGS. 18 and 19 show one constructive version for the tubular air vent (5), which is placed vertically inside the container (1) and is completely independent so that its lower end (6) may be positioned quite close to the floor of the bottom of the aforesaid container (1), while its upper end, after going through the container body is sufficiently exposed for the air to come in and out from the air vent. Logically, the tubular air vent (5) can be fixed in different ways.

Therefore, the constructive version shown in FIGS. 18*e* 19, highlights the fact that the tubular air vent (5) is located inside the container and so does not need to be attached to the wall of the container as it is the external air inlet at the upper part of the set.

The air vent (5) may have diverse shapes, as long as the external air can flow to the bottom of the container without needing to have a vacuum or to have to go through the liquid, in other words, as long as the principle of communicating vessels can occur.

Figure 22:
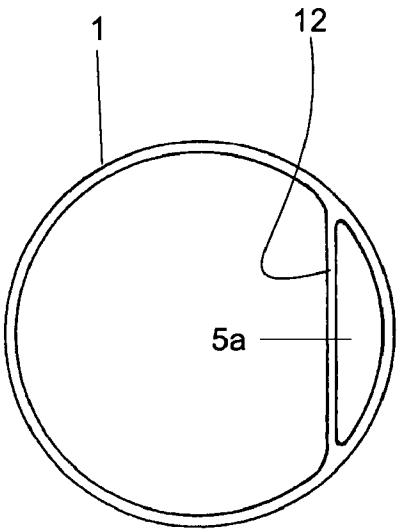
FIGS. 20 to 22 illustrate one constructive version for the air vent, showing a perspective, a cross-section of the lateral view and the body.
Figure 21:
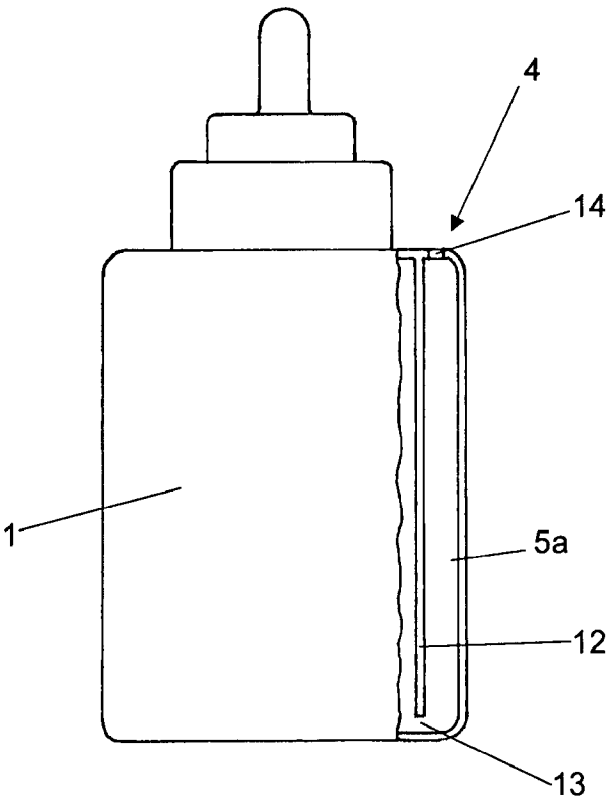
Figure 20:
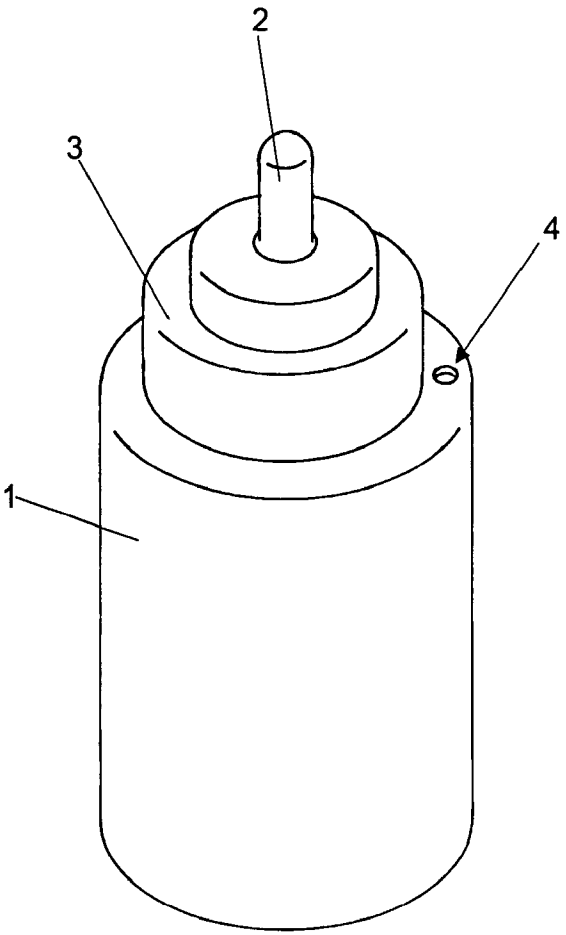

As for FIGS. 20, 21, 22, according to another construction variation, the air vent (4) is configured by an integrated internal wall (12) placed strategically close to the wall of the body (1) of the container so that an air duct (5*a*) is formed between both parts, whose lower end has a passage (13) to let air in towards the bottom of the container, while another passage (14) at the upper end, a hole or other geometric opening, functions as the air vent as such. Therefore, in this case, the air vent does not need to be made up of a tube in other words, the internal wall or partition replaces it, as it has the same function.

Figure 24:
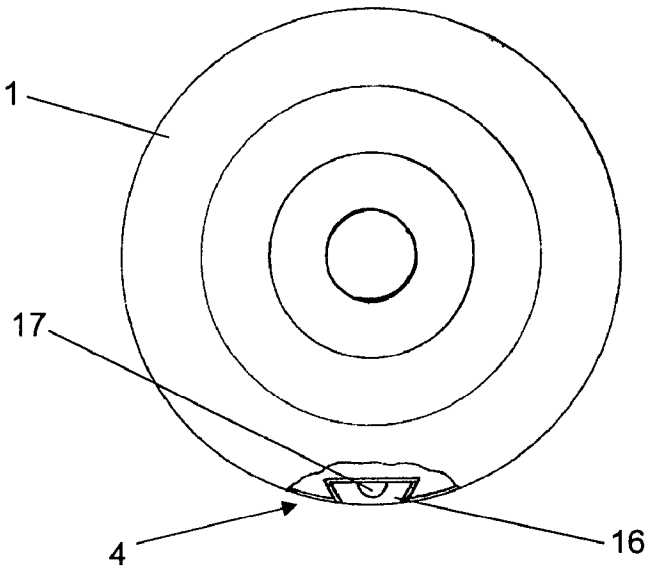
FIGS. 23 to 25 illustrate another constructive version for the container body and the air vent, showing a perspective, a partially cross section view of the body and an amplified cross-section.
Figure 25:
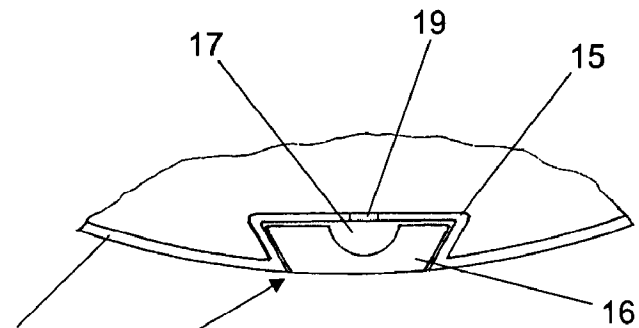
Figure 23:
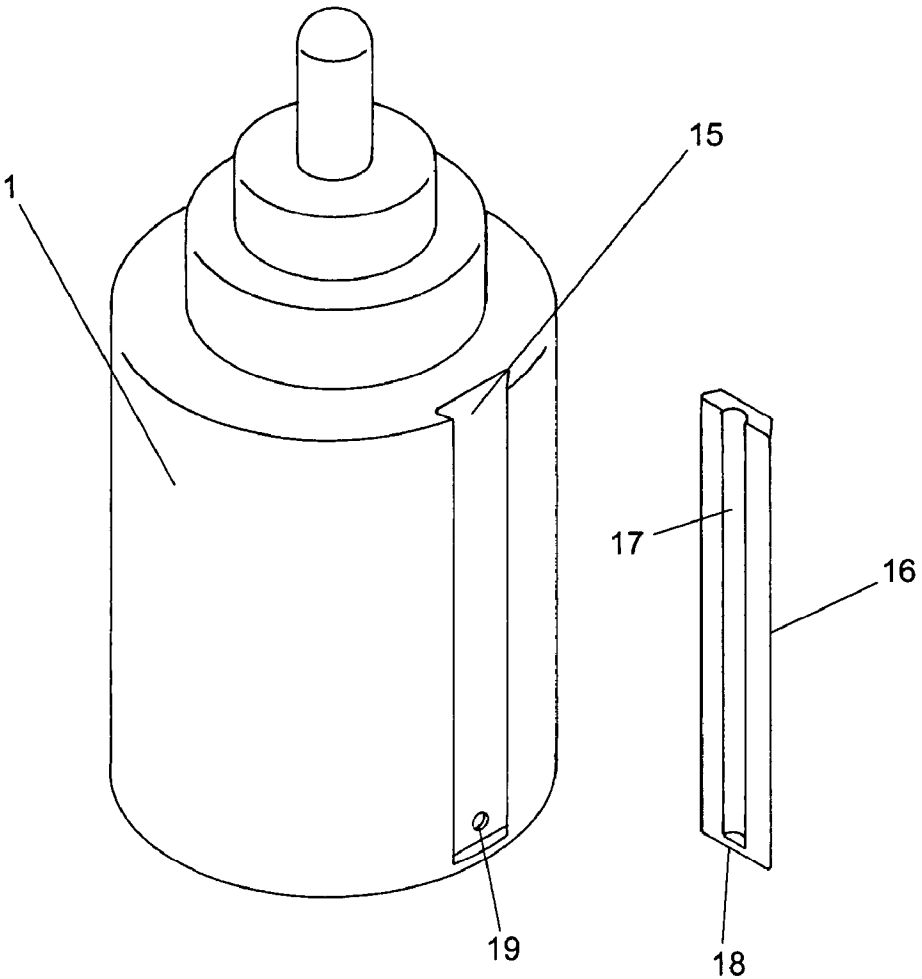

Another construction variation for the air vent (4) is illustrated in FIGS. 23, 24, and 25, with a different construction from the previous ones and, in this case, the lateral face of the body (1) of the container has an external vertical fitting (15) for a strip-shaped (16) complement that, in this case, besides having an internal face with a longitudinal groove (17), also has an appropriate transversal geometry to slide into the fitting (15) and forms an internal duct, that is, the air vent (4), whose upper part forms an air inlet, while its lower part—though it has a closing (18)—enables the groove (17) to communicate with a hole (19) located at the lower part of the fitting (15) so as to pass transversally through the container wall (1) quite close to the bottom. Therefore, this set also has an external air inlet bringing the air to the bottom of the container (1) without it going through the liquid and preventing the formation of vacuum at the bottom of the container (1) before the liquid is even discharged or sucked. This construction has the advantage of enabling the part (16) to be easily removed when the set is sterilized as in the case of baby bottles generally speaking.

As previously said, many other construction forms may be designed, depending on the application, as long as they can apply the principle of communicating vessels.

Figure 27:
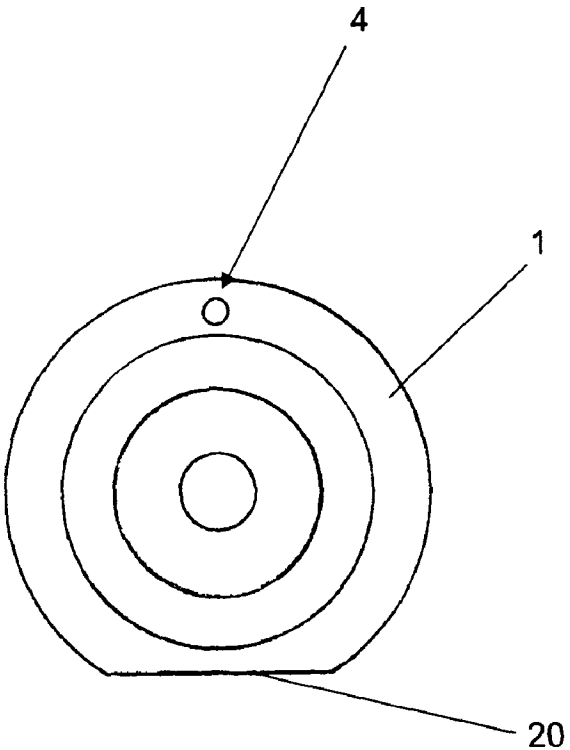
FIGS. 26 and 27 show an alternative construction for the container body, including a perspective and a top view, enhancing another variation of air vent, though in this case mainly related to the body of a baby bottle.
Figure 26:
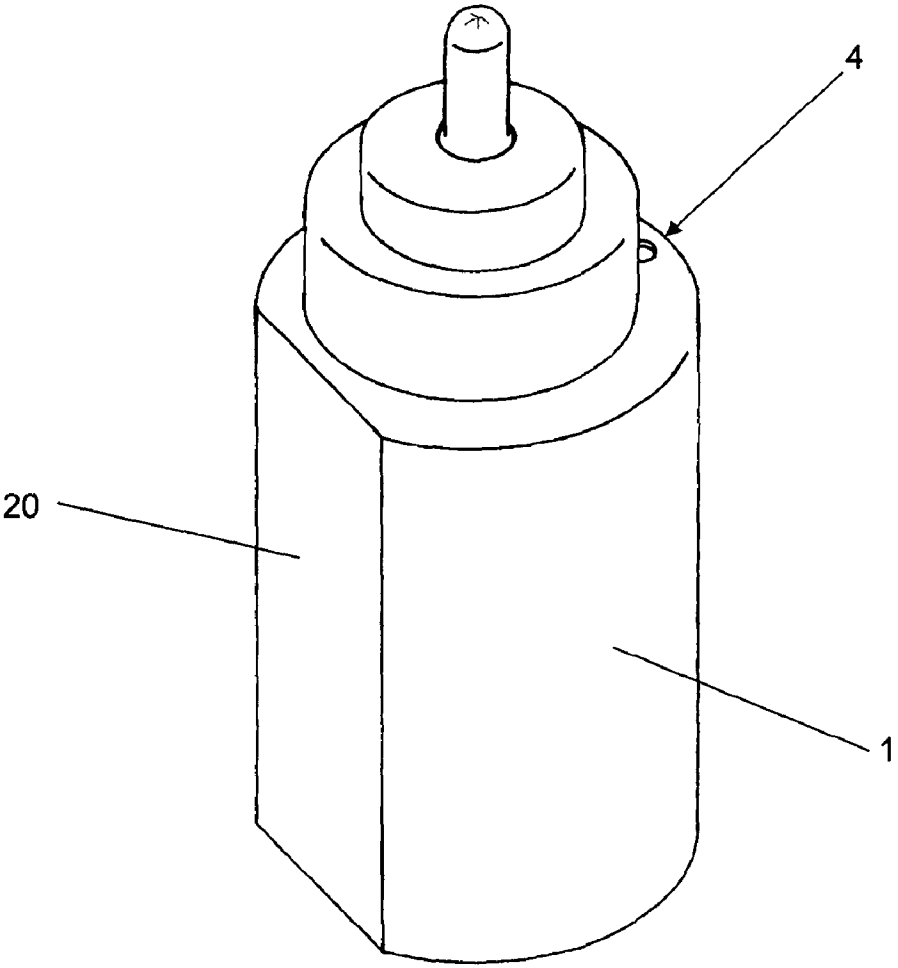

According to another construction variation, illustrated in FIGS. 26 and 27, the body (1) of the container has a lateral and longitudinal flattening (20) along the entire height and on the opposite side of the air vent (4). This construction is ideal for some applications, like in the case of baby bottles, as they aim at keeping them horizontally, on the table (when external air is already at the bottom of the baby bottle) before preparing for feeding.

Figure 29:
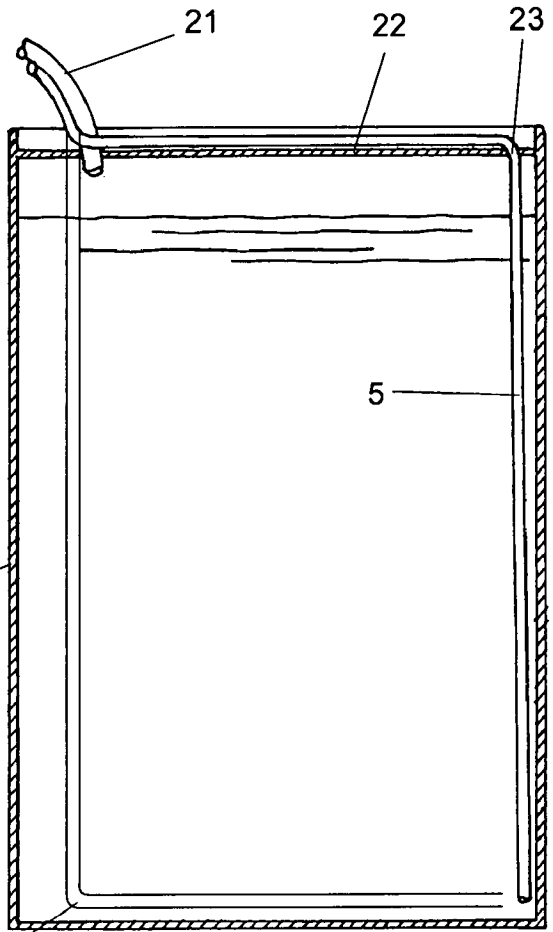
FIGS. 28 and 29 are constructive versions for specific applications, as for instance, olive oil and other oils, showing cross-section lateral views in amplified details.
Figure 28A:
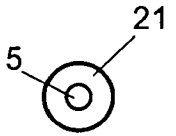
Figure 28B:
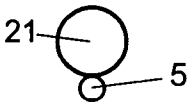
Figure 28C:
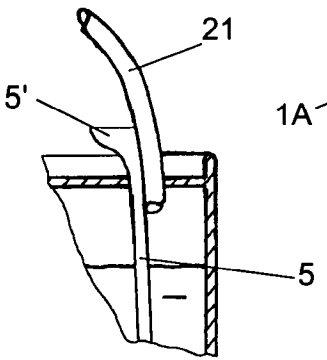
Figure 28:
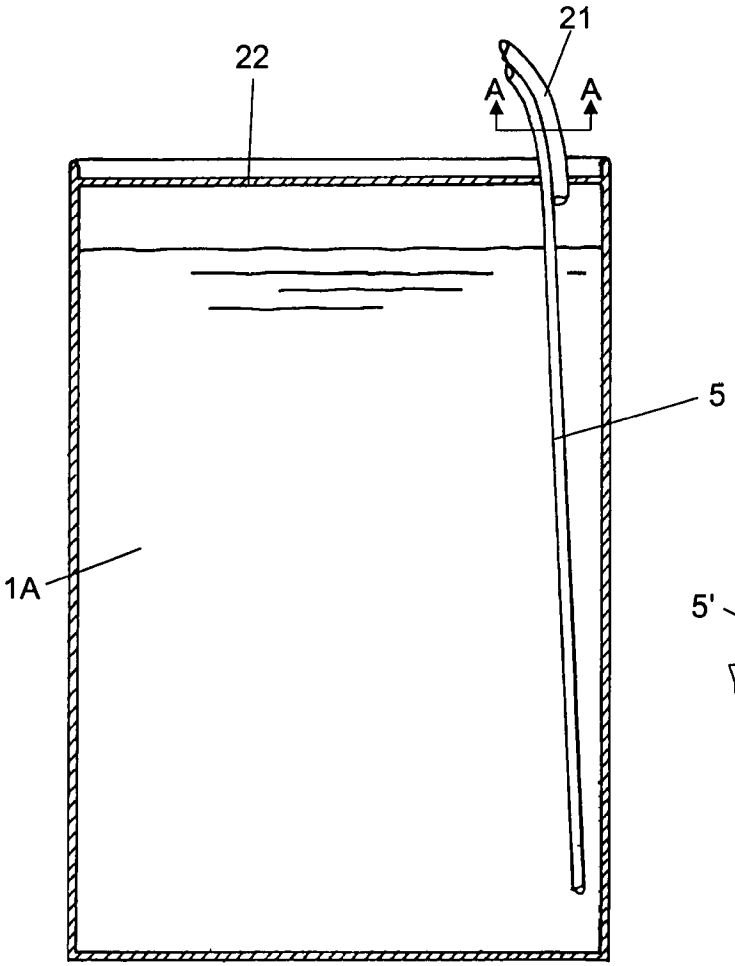

As we have mentioned before, the proposed air vent can have several constructive variations, for different applications, as for instance, the FIGS. 28 and 29, where the modifications have been designed mainly for olive oil cans. This construction version is characteristic for having an air vent (5) combined with a short tube (21) and the air vent tube (5) is placed in the same way and its lower end is placed quite close to the bottom of the container, while its upper end is exposed and lets air in; the second tube (21) is combined at this end and its lower end goes through the lid or the upper wall (22) of the container (1), while its upper end is quite adjacent to the end of the air vent tube; as a matter of fact, both tubes can have different shapes like those showed in the A-A sections of the FIGS. 28A and 28B', among others; these show that they can be placed side by side or concentrically, or they can even be integrated in one single part or not without interfering with their functioning; moreover, as shown in FIG. 28C, the air vent (5) tube mouth (5') at the base of the tube (21) is wider to configure a droplet collector On the other hand, the air vent tube (5) may have its ends directed to opposite sides as shown in FIG. 29, and do a curve (23) or (24). Anti-drop discharge spouts or normal discharge spouts may be used in both cases. In the case of FIG. 28, the discharge spout is not conventionally installed, which enables the principle of communicating vessels, in other words, when you start pouring the olive oil, none of it will be in the small air vent tube and the external air will go directly to the bottom of the can without going through the olive oil, thereby preventing the olive oil from spurting out of the discharge spout and coming out from the air vent when the can is squeezed. The discharge spout set and the air vent tube are economical and hygienic, as they enable to control the flow of olive oil and prevent any dripping or leakage through the air vent aperture, as it happens with the current olive oil cans with or without discharge devices. If a normal discharge spout is used—not an anti-drop spout—the air vent aperture underneath the discharge spout will collect any possible dripping, as per FIG. 28C'. When the can is used again the dripping will then be pushed back into the can by the external air thanks to the formation of vacuum.

In the case of FIG. 29, the discharge spout is configured conventionally and the air vent aperture unconventionally, and the air vent tube will go down to the bottom of the can even when coupled to the discharge spout as shown in the Figure. This configuration does not allow for the principle of communicating vessels; therefore, the olive oil likely to be in the small tube will only go the bottom of the can on pouring the olive oil thanks to the vacuum formed. It is important to note that this is likely to occur when squeezing the can before or as the olive oil is poured: in that case a minute amount of olive oil that is likely to be in the small tube may come out through the air vent aperture joining to the olive oil discharge flow. The effect of possible leakage will decrease, as the level of olive oil decreases. No leakage will occur if the can is squeezed during a few seconds after starting to pour, since there no liquid will be left in the small tube (5).

Figure 31:
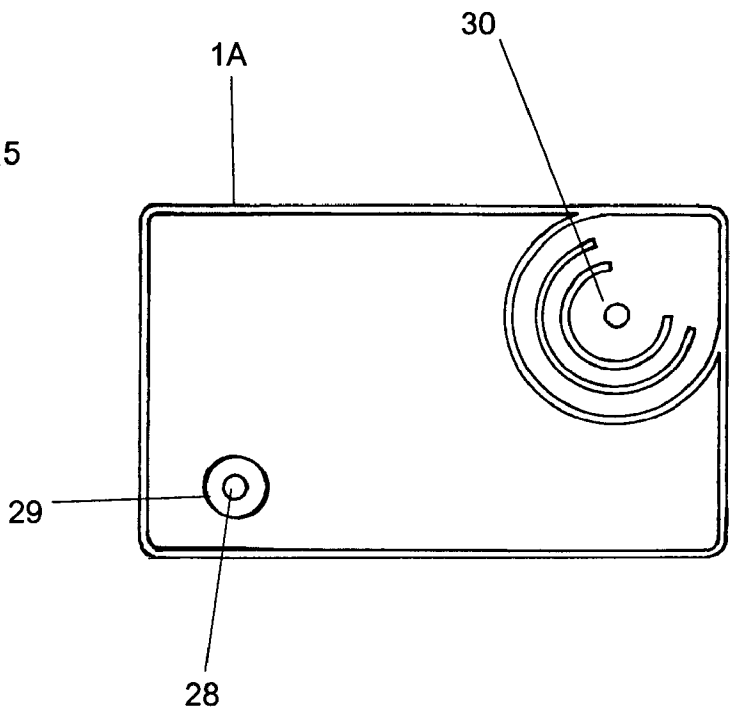
FIGS. 30 and 31 show another constructive type mainly for olive oil application.
Figure 30:
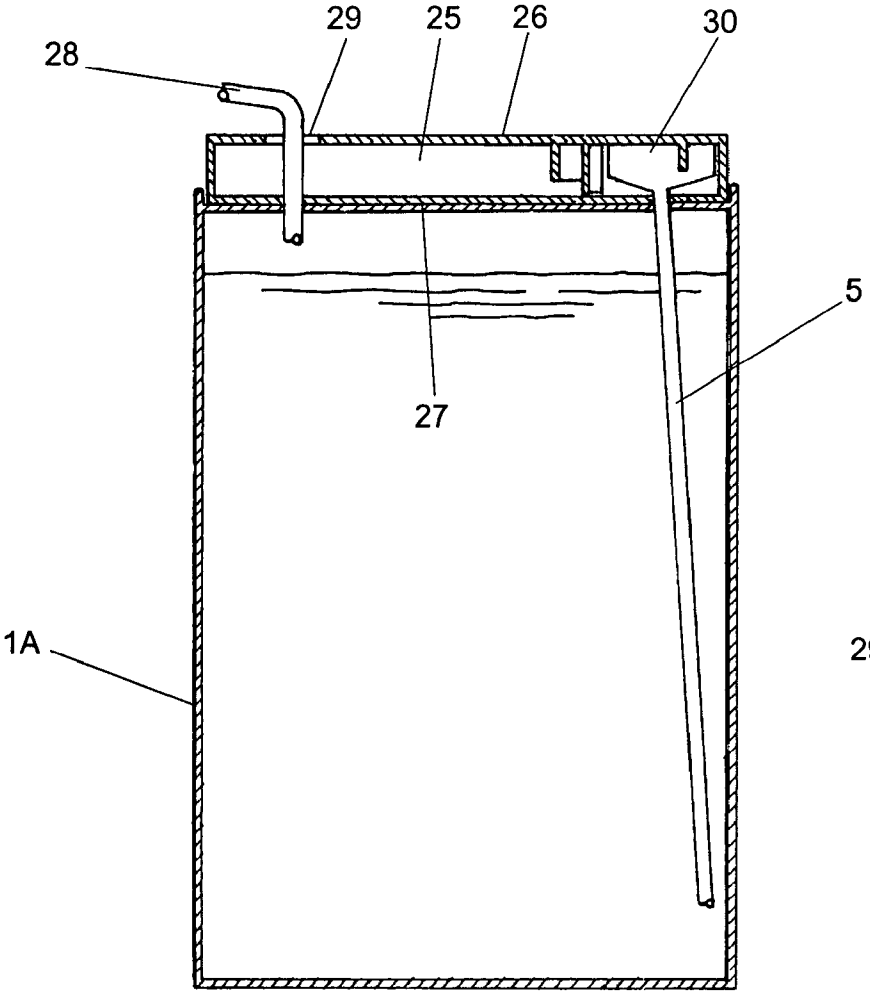
Figure 32B:
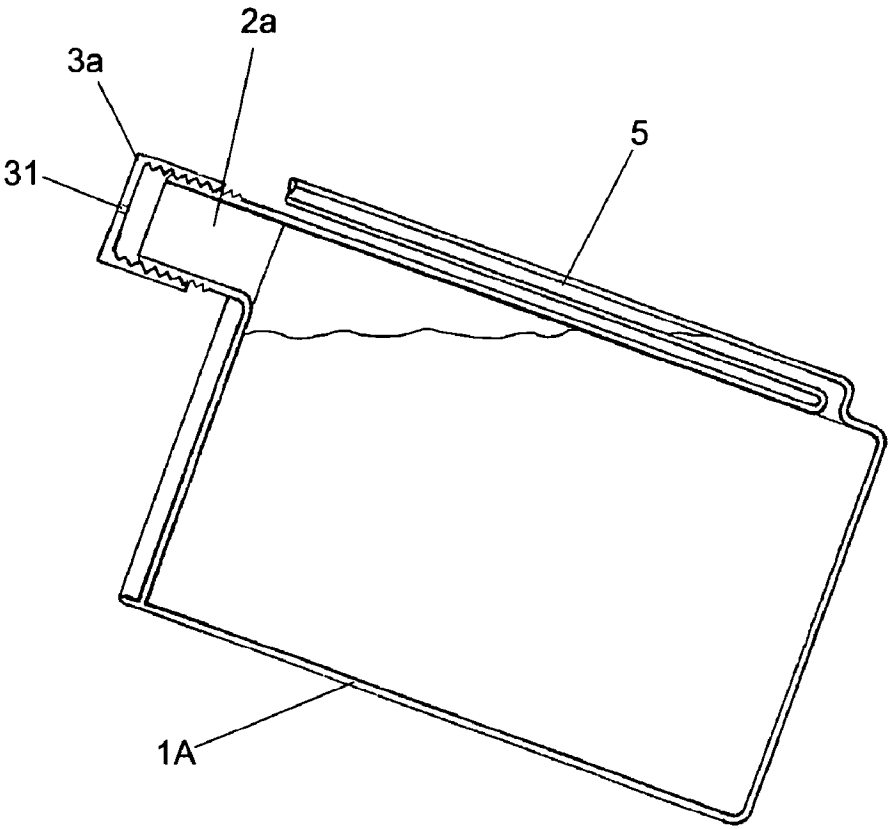
FIGS. 32A to 32D are lateral views for another constructive version for the air vent.
Figure 32A:
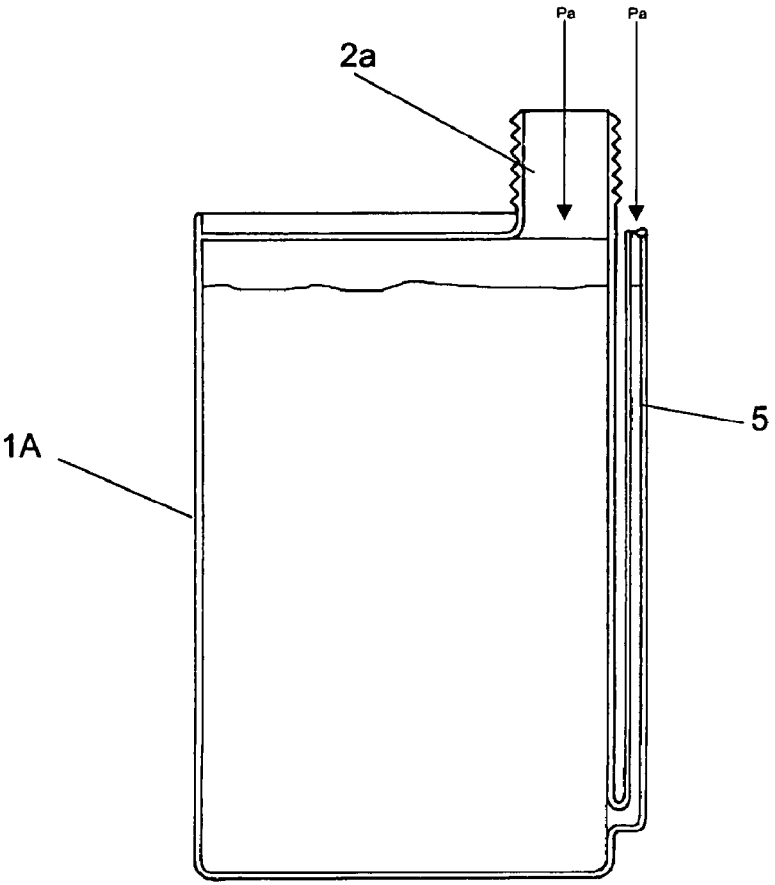
Figure 32D:
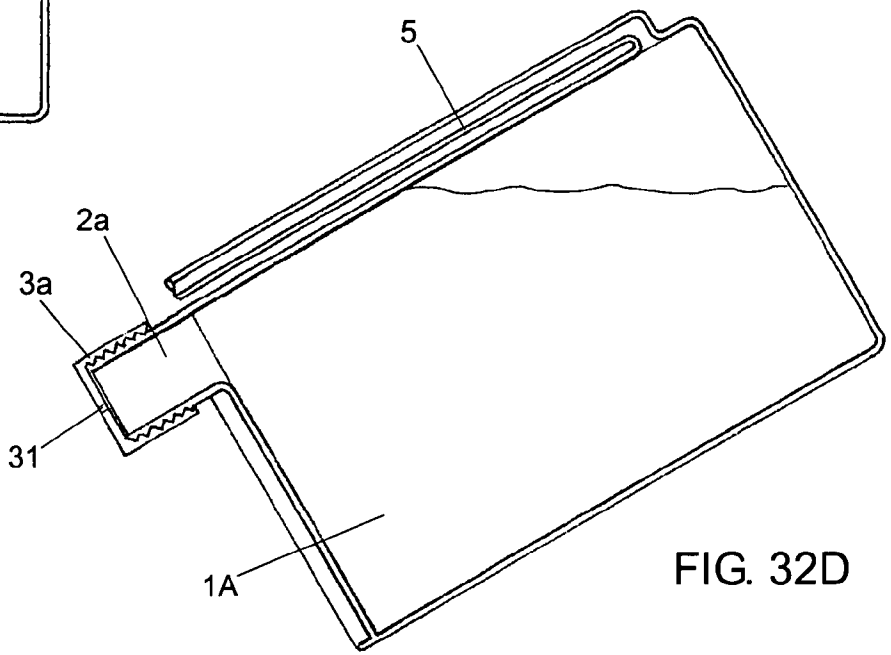
Figure 32C:
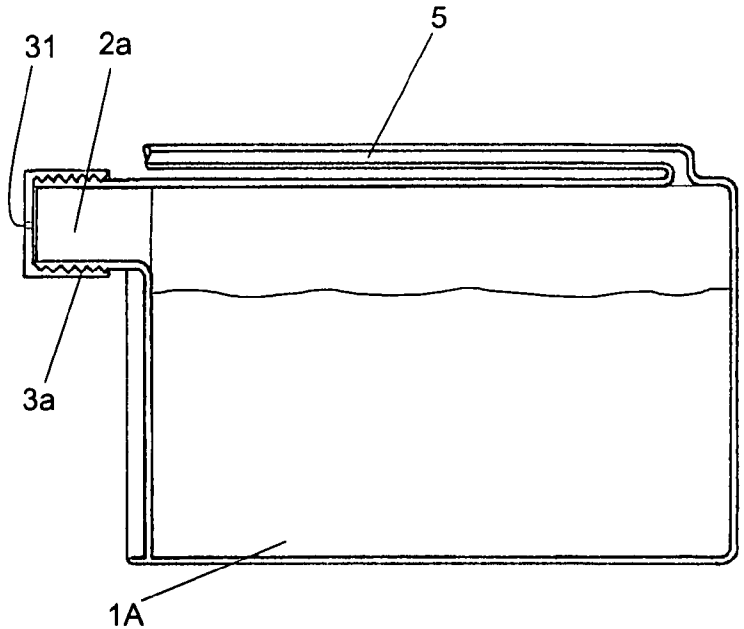

FIGS. 30 and 31 also illustrate a specific construction for olive oil containers, and are a variant of FIG. 29, where a labyrinth-chamber is placed at the aperture of the air vent to enable air to enter and prevent olive oil from coming out, and, in this particular case, the liquid in the small tube (5) does not leak outwards, even when squeezing the can. In this construction, the upper part of body of the container (1) is made up of a chamber (25), which is defined by an upper wall (26) and an internal wall (27), which with the aforesaid body forms an isolated chamber from the contents of the container; and also, on one side, this chamber has a tubular outlet spout (28), which goes through both walls (26-27) so that the contents of the container may flow through it; furthermore, there is one or more air inlet openings (29) on the upper wall (26) and around the outlet spout (28) which lead inside the chamber (25), which also has an internal labyrinth (30) on the opposite side of the tubular outlet spout (28), where the upper end of the tubular air vent (5) is located; the lower end of the tubular air vent reaches almost the bottom of the container (1), thereby providing an efficient air vent system for olive oil cans. This construction has the advantage of enabling air to enter through (29-30-5) and avoids the olive oil likely to be in the small tube from coming out when the can is squeezed before or at the beginning of discharge. The chamber (30) works as an intermediate tank (labyrinth-chamber), which enables external air to enter and stops possible droplets from spurting out, should the container be squeezed, mainly before and at the beginning of discharge, as after initiating discharge, the olive oil in the small tube and/or the droplets will go down to the bottom of the container thanks to the formation of vacuum in the container. The olive oil that is likely to remain in the aforesaid chamber as a result of the droplets goes back inside the container when placed back in the vertical position. Please note that occasional droplets may occur when the container is squeezed and not when the container is tilted.

Depending on the type of container and the type of application, no chamber (25) will be required, as an air vent aperture (4) will suffice; in other words, the external air entrance must be constructed next to the labyrinth-chamber (30). Obviously we may use several types of devices to avoid leakage when the container is squeezed, as previously mentioned.

The set defined by the discharge spout, air vent tube, and its details may obviously be used in other olive oil containers, be they metal, glass, plastic, or even for other liquid containers.

Another constructive type is that represented in FIGS. 32A to 32D, in which the discharge spout (2*a*) is not coaxial to the container. This construction may be required when the lid (3*a*) of this spout has a discharge micro aperture (31), which may stop the occurrence of the principle of communicating vessels between the inside of the container (1) and the air vent tube (5) because of the accumulation of the very liquid in this aperture (3*a*) (viscosity etc.) thereby preventing the equalization of pressures. To go round this problem, a screw casing head may be constructed on the discharge mouth (2*a*) to screw to container lid on so that an air passage is made when the container lid is partially opened when the container is turned in for the liquid in the small tube (5) to go back to the bottom of the container without forming any vacuum. After that, the lid will be screwed on tightly. Instead of having a partially screwed lid, other means can be used, as they enable external air to enter to maintain the balance in pressure until the beginning of discharge.

Figure 33:
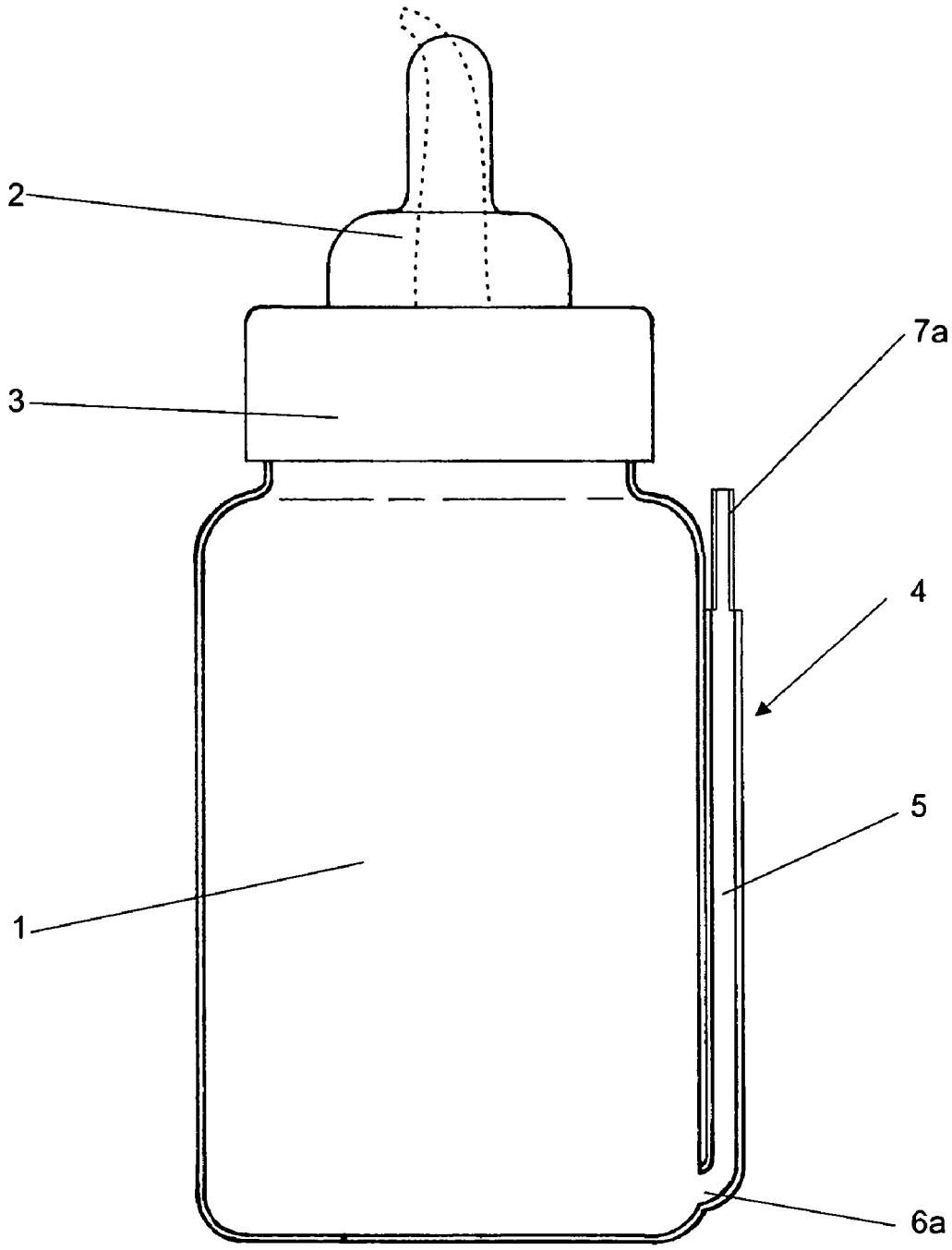
FIG. 33 illustrates another design for the air vent, that is, the air vent tube may be made with two or more diameters.

FIG. 33 shows another constructive variation for common or non-specifically designed containers and, in this case, an air vent (4) made with a tube (5) with different diameter is used, being the upper one (7*a*) with a smaller diameter than the lower one (6*a*), enabling the air inlet and making it difficult for the liquid to flow outside, in order to avoid leakage. This solution is very interesting for viscous liquids as olive oils, etc. On the other hand, in this case, one only tube can present different diameter or the combined use of two different diameter tubes, the smaller one being fitted into the bigger, though other constructions may be used to the same purpose.

Under normal conditions of usage, at the beginning of the pouring, the liquid in the air vent goes to the bottom of the container, due to the principle of communicating vessels or initial vacuum and it will hardly leak through the air vent, in case of inappropriate handling, mainly due to difficulty in flowing through the tube with the smaller diameter. The measurement of these tubes will depend on the characteristics of the liquids. Besides, the smaller diameter tube will be able to have different shapes whenever the necessity of blocking the flow of liquid (leakage) presents itself. Depending on the liquid, it is possible to have one only diameter. In short, it is possible to have several devices that can enable the inlet of air and prevent the outlet of the liquid.

Figure 34B:
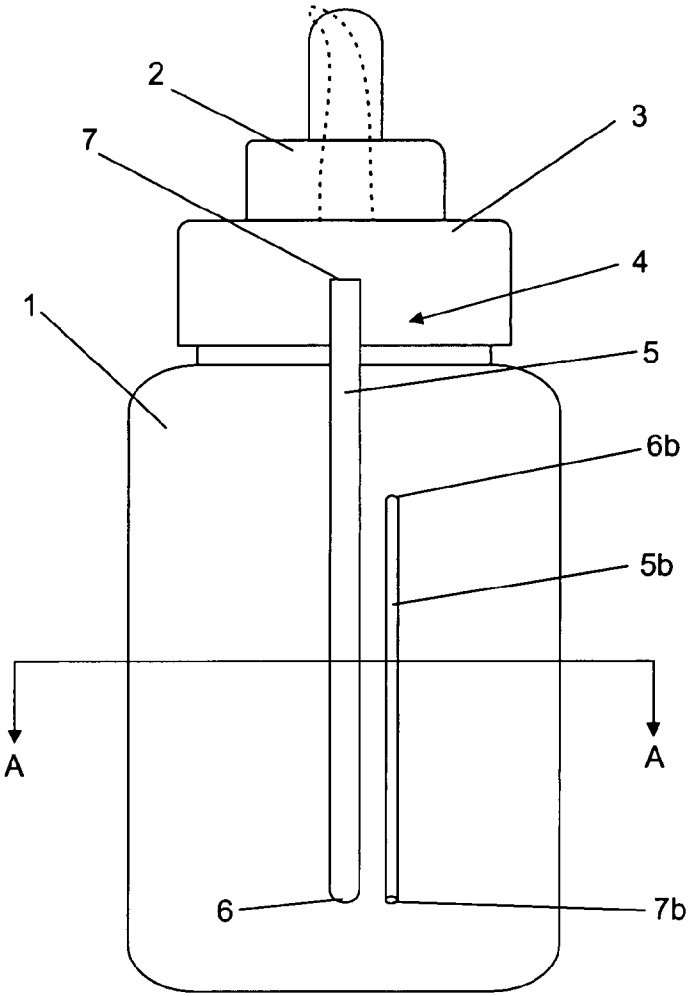
FIGS. 34A to 35 show several views of a air vent system having two tubes in inverted position.
Figure 34A:
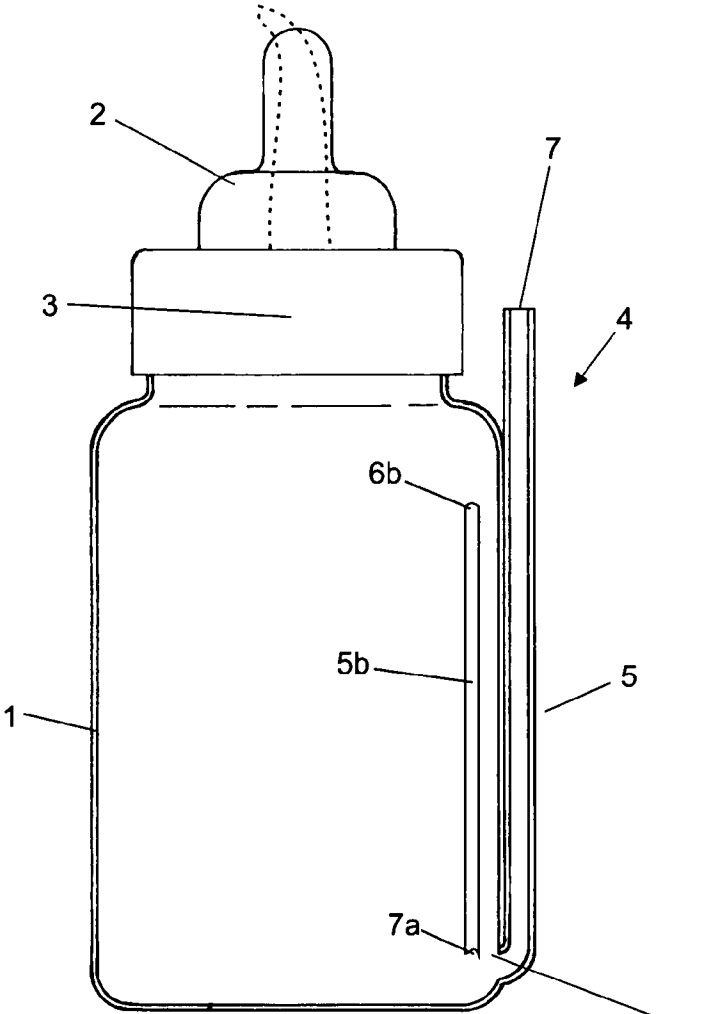
Figure 34C:
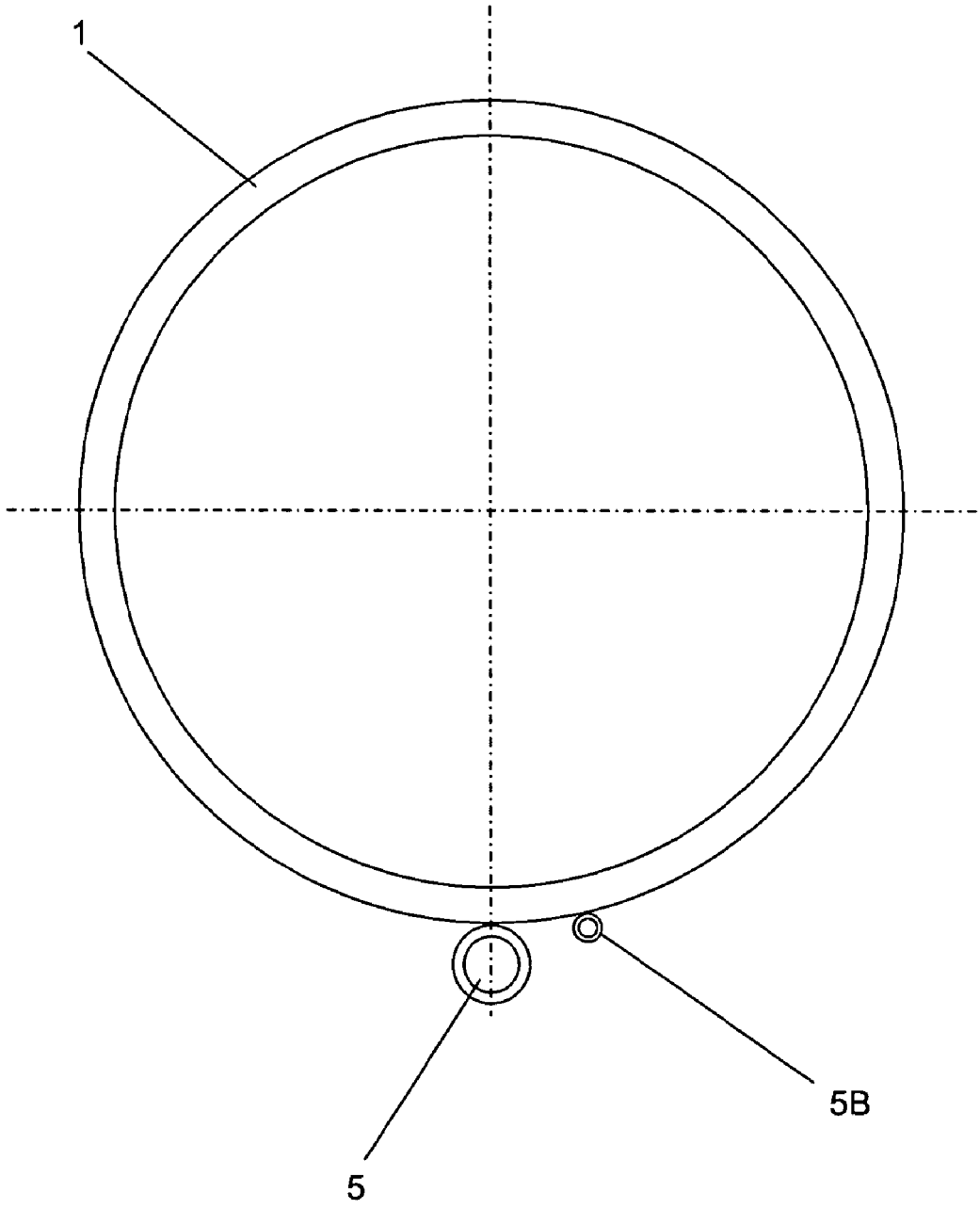
Figure 35:
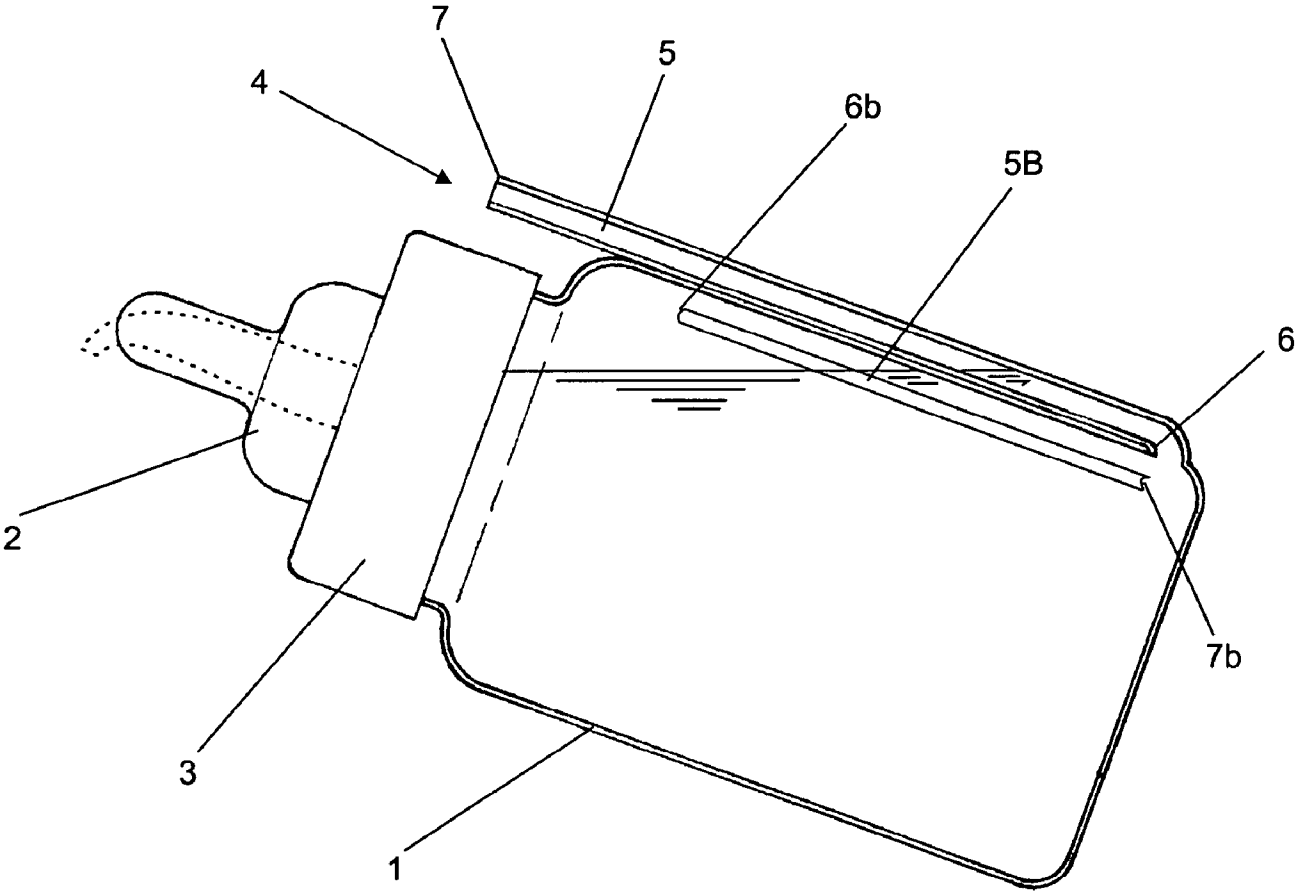

According to the FIGS. 34A to 35, whenever the principle of the communicating vessels is desired and the container is not designed to do so, or a common container is being used, a solution would be the assembling of a little auxiliary air vent tube (5*b*) substantially close to the tube (5), though with a much smaller diameter, with the purpose of keeping the pressure equalized at the levels of the liquid inside the container and the air vent tube.

This auxiliary air vent tube (5*b*) is in an inverted position in relation to the normal air vent tube (5), that is to say that its external air inlet (7*b*) is in a lower position or turned downwards, while its extremity (6*b*) is connected to the inside of the container (1). This intake of air between the lid and the maximum level of the liquid inside the container. There is no liquid in this little tube, ant it has to be made with the smallest diameter possible, in order to allow the intake of external air.

As the container is tilted to the vertical position, with the pouring or suction spout blocked or closed, the liquid will rise in this little tube, acting as a seal but it will not leak through it due to the principle of communicating vessels, as its length should be chosen according to its usage.

Figure 36A:
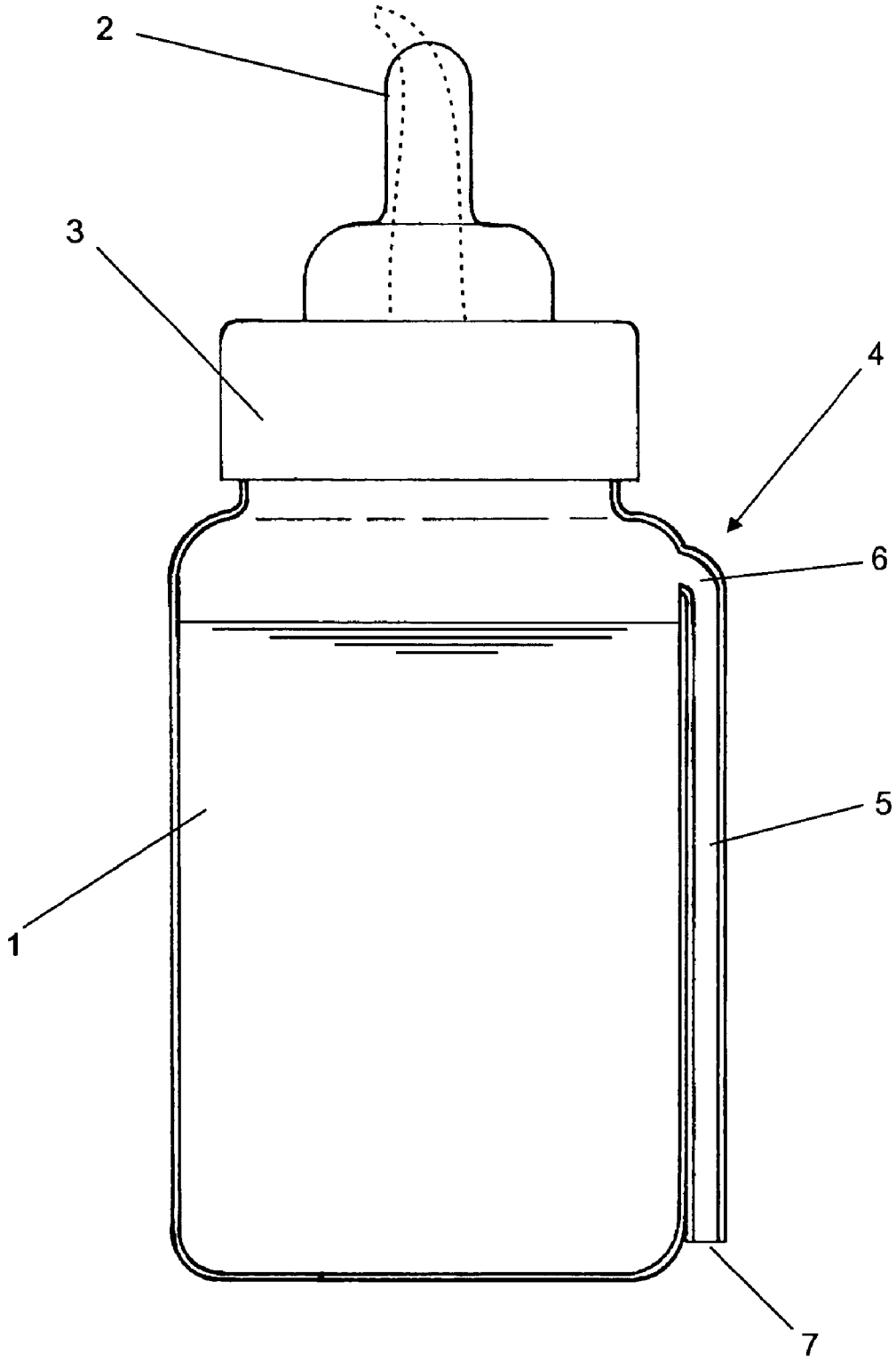
FIGS. 36A to 36C show one particular air vent construction, that is, the air inlet is at the lower end while the upper end is placed inside and at the upper part of the container body.

FIG. 36A shows another constructive variation for the air vent (4) In this case, the tube (5) is inverted, with its open end (7) turned downward, close to the bottom of the container, while its other end (6) is substantially close to the lid (3), where it is connected to the inside of the container, and where it will insert the air that enters through the lower end.

Figure 36B:
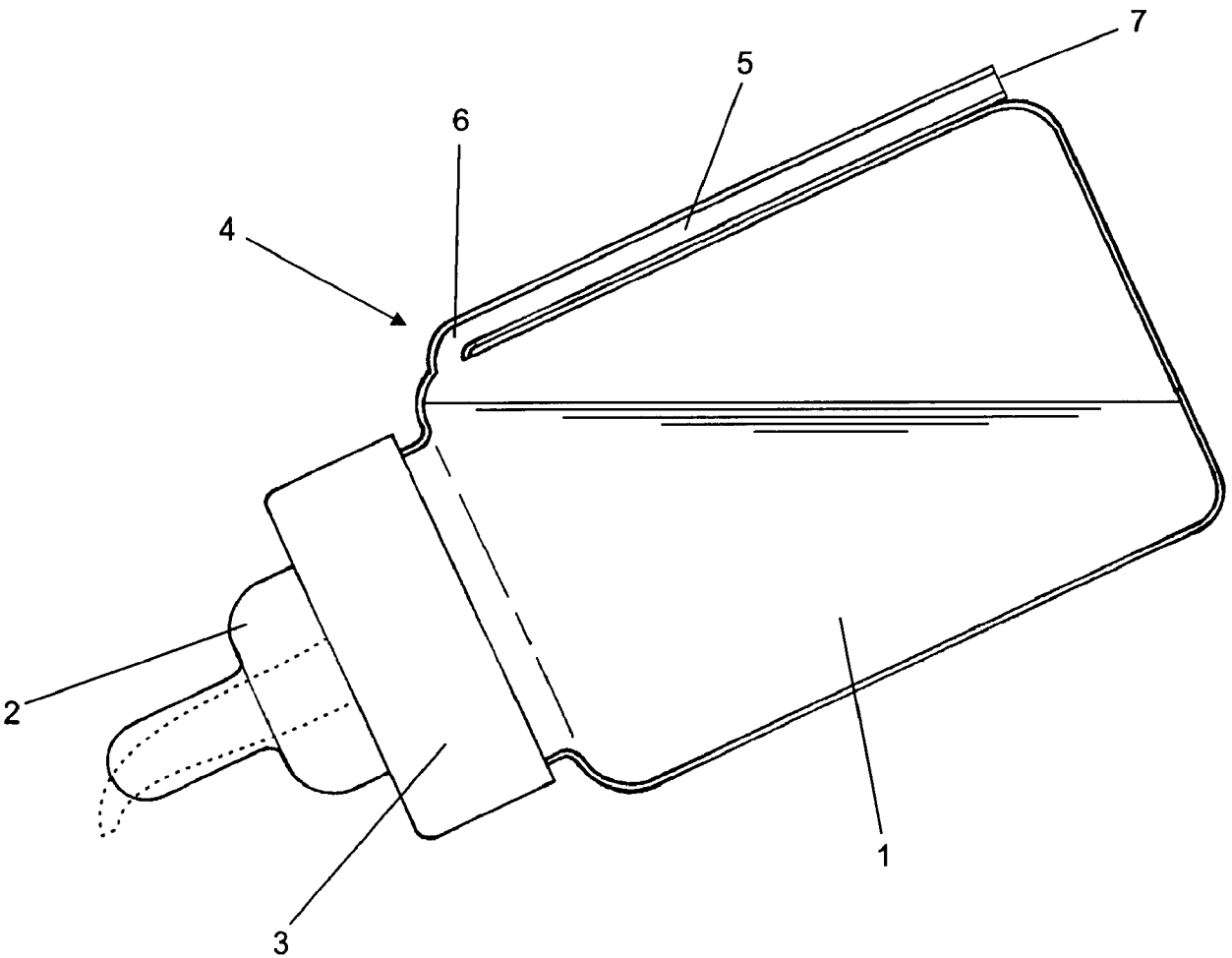
Figure 36C:
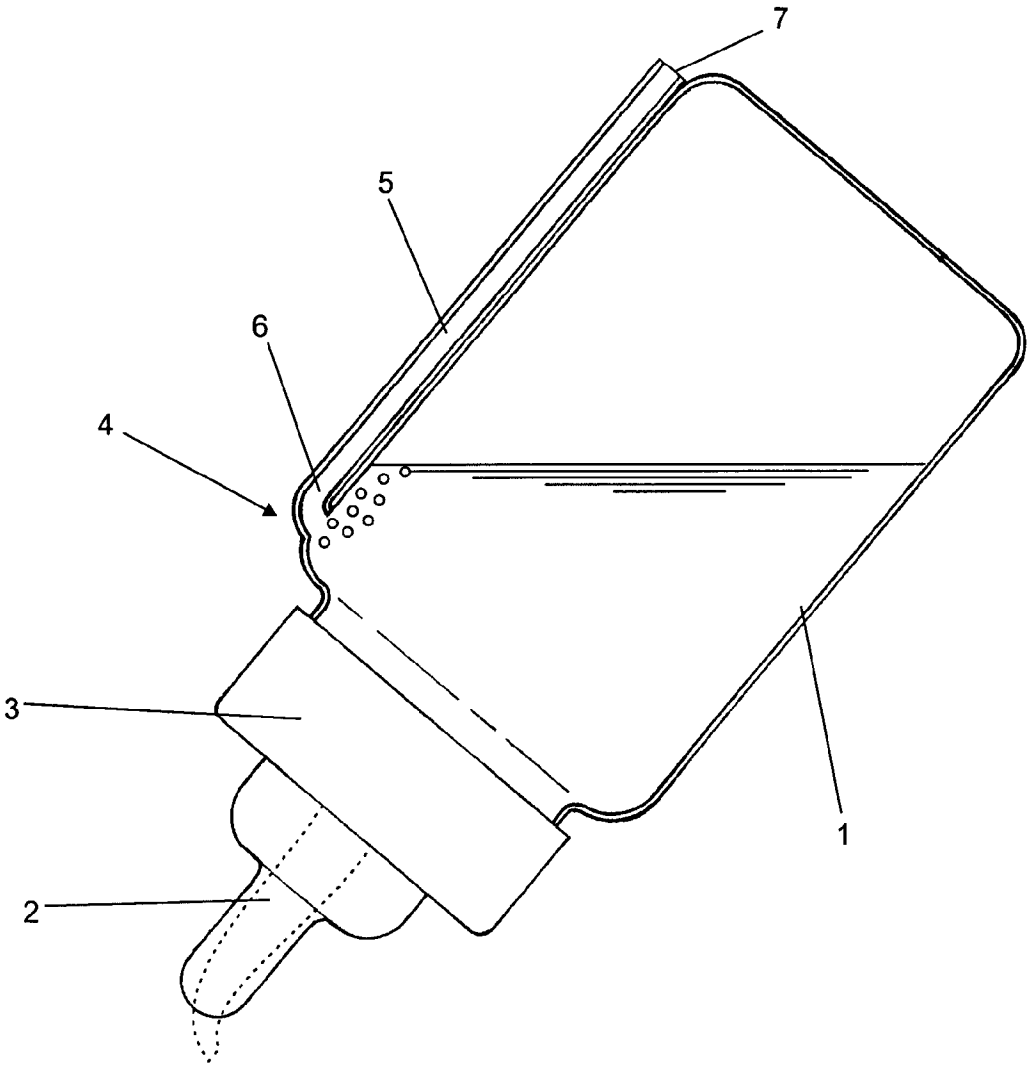

As the container is tilted according to FIG. 36B the pouring or suction of the liquid will start and the external air gets into the container and goes to its bottom where there is only air. When, due to the inclination of the container, the liquid exceeds the opening (6) the external air will then go through the liquid, and will keep on going until the bottom of the container (FIG. 36C).

Whatever the position, the external air will constantly go to the bottom of the container and never to the spout/nipple and there will not be the possibility of leakage through the air vent tube.

Consider the following:

a. The opening (6) is not at the lid nor in the spout/nipple, which will avoid the release of air along with the pouring or suction of the liquid;

b. There is not an internal coupled tube to the spout/nipple to guide the outlet of liquid.

Figure 38:
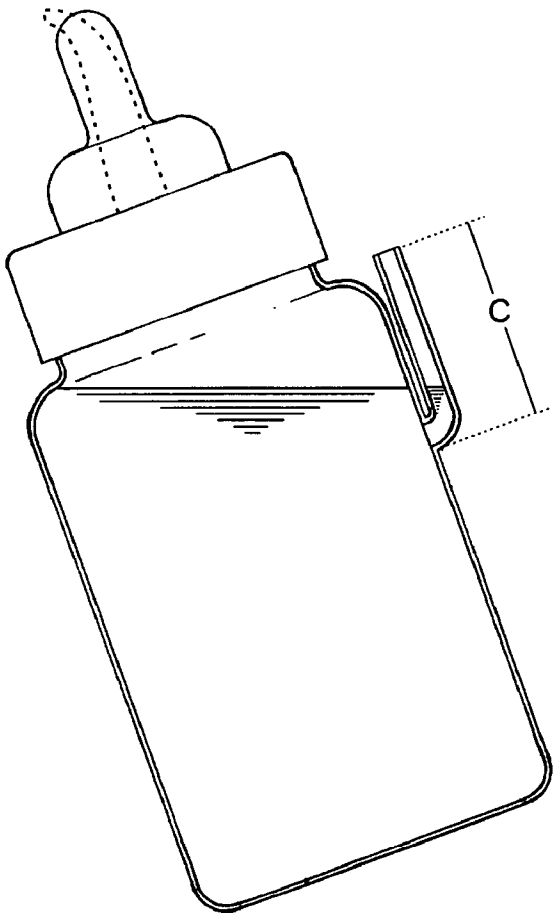
Figure 37:
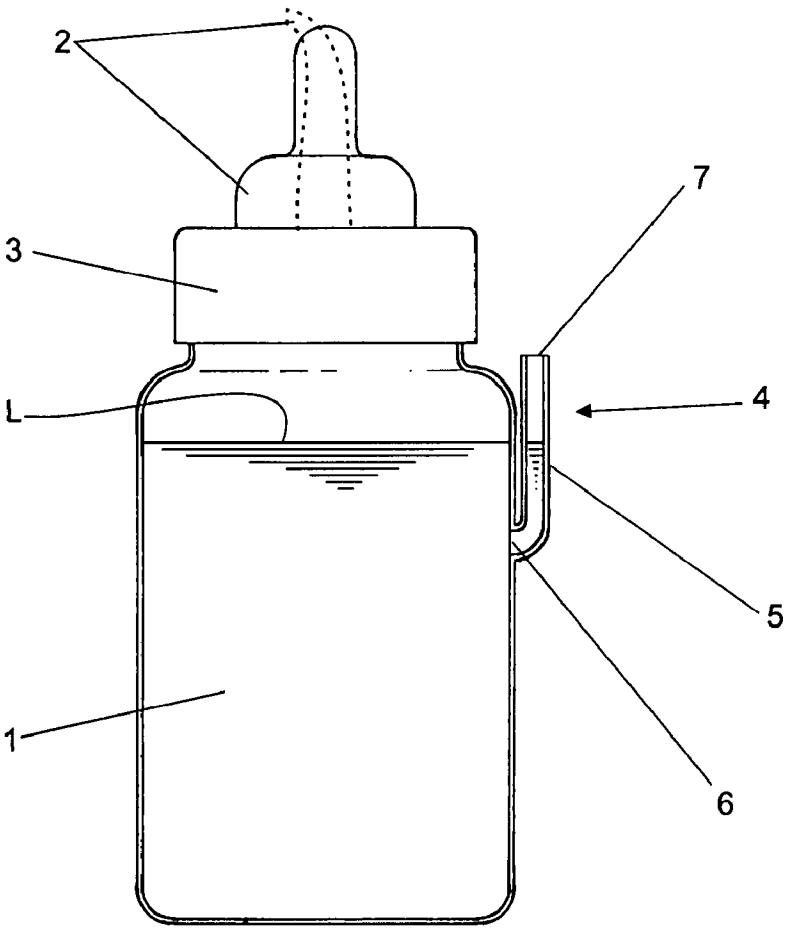
Figure 39:
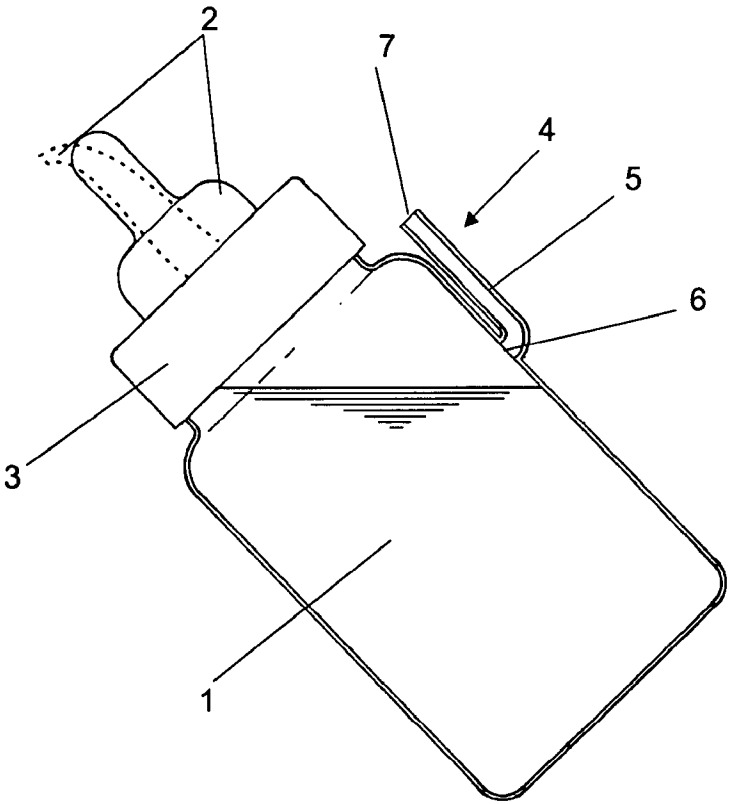

FIGS. 37 and 38 show an alternative construction for the air vent (4) which is characterized by the fact that the little air vent (4) tube (5) have its end or lower opening (6) strategically positioned before the bottom of the container. This constructive condition provides the item with a functioning effect similar to the one initially proposed such as it is shown by the FIGS. 39 and 40, whereby it is verified that, in this case, the air vent (4) also works according to the principle of communicating vessels, in other words, the liquid inside such tube (5) flows to the inside of the container (1) when such container is initially poured (FIG. 38), the pouring of the little tube (5) occurs until the level of the liquid reaches the lower opening (6) and, from this moment on, the air vent system (4) continues to work in order to avoid the vacuum formation. When the level of the liquid (FIGS. 39 and 40) is below the opening (6), the external air will be constantly in touch with the internal part of the container and, therefore, also in this construction there will not be vacuum formation and the external air will not cross the liquid inside the container and there will not be a leakage through the air vent when the container is poured until the level of the liquid reaches the opening (6), according to FIG. 40. As the level of the liquid is subsiding, the container can be poured up to 180 degrees or more, without the occurrence of leakage. Allowing for the container to be poured at 180 degrees, and when the level of the liquid inside is at its maximum level, an air vent tube whose opening (6) is very close to the bottom of the container can be used, as it was described previously, or designed in such a way that (see FIGS. 41 and 42) the volume (VI) above the lower opening of the air vent tube (6) is the same as the volume of the liquid (V2) in the container, in a way that, as the container is poured at 180 degrees, the level of the liquid is below the lower opening (6) of the air vent tube.

Figure 42:
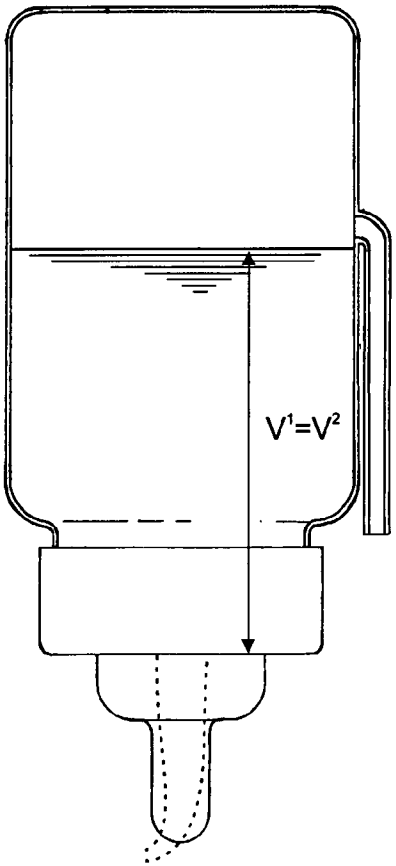
Figure 41:
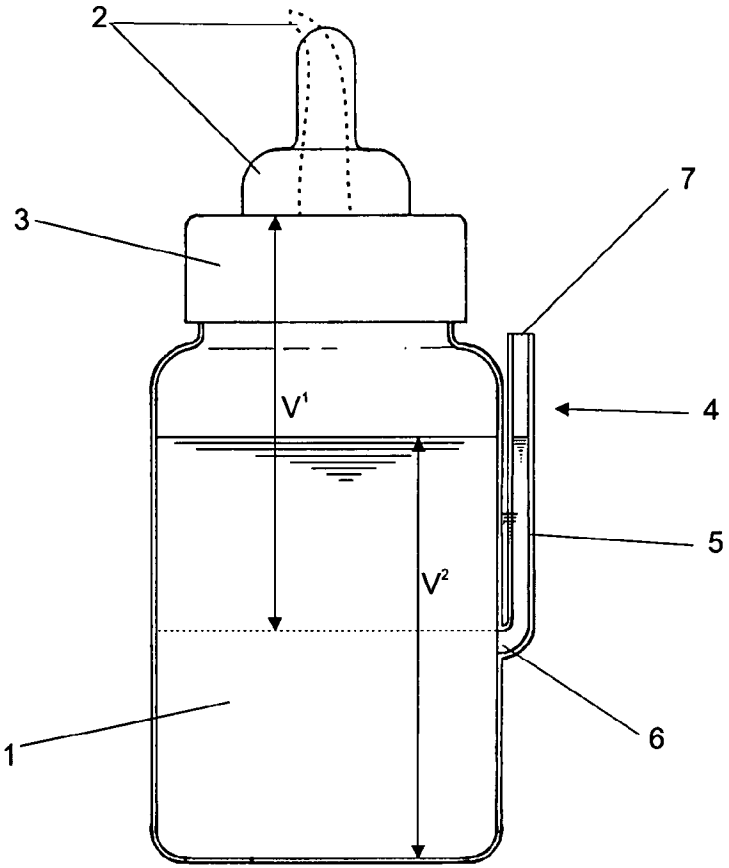

Therefore, as shown also by FIGS. 41 and 42, the parameters as for the length (C) of the air vent tube (5) the volume (VI) below the lower opening (6) of such air vent tube (5) and the application of the set, will define the inclination angle of pouring allowed for the container (1) without the occurrence of leakage and with the perfect functioning of the air vent system. According to the applications and the manufacturing costs intermediate values will be set for (C) and (VI). In other words, the air vent tube may have its opening (6) located from near the upper part of the container to near the bottom, while the volume (VI) may be any fraction of the volume of the liquid inside the container (V2) or be the same as it.

The extreme case of the tube with zero length corresponds to the air vent of olive oil cans or other containers, in which an orifice is made so that the external air may enter, cross the liquid and reach the bottom of the container. In this case, there may be leakage through the air vent depending upon the inclinations of the container and whether it is squeezed. The other extreme is the lower opening (6) of the air vent tube, located in the bottom of the container, as explained in the beginning of this presentation.

Figure 44:
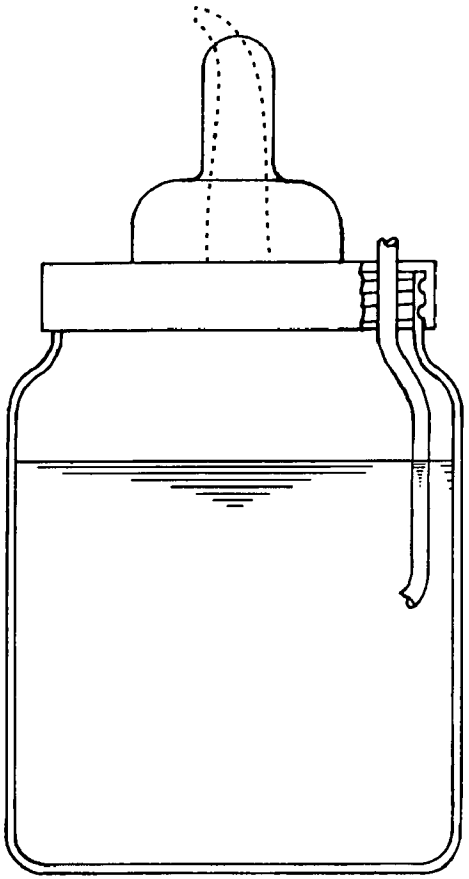
Figure 43:
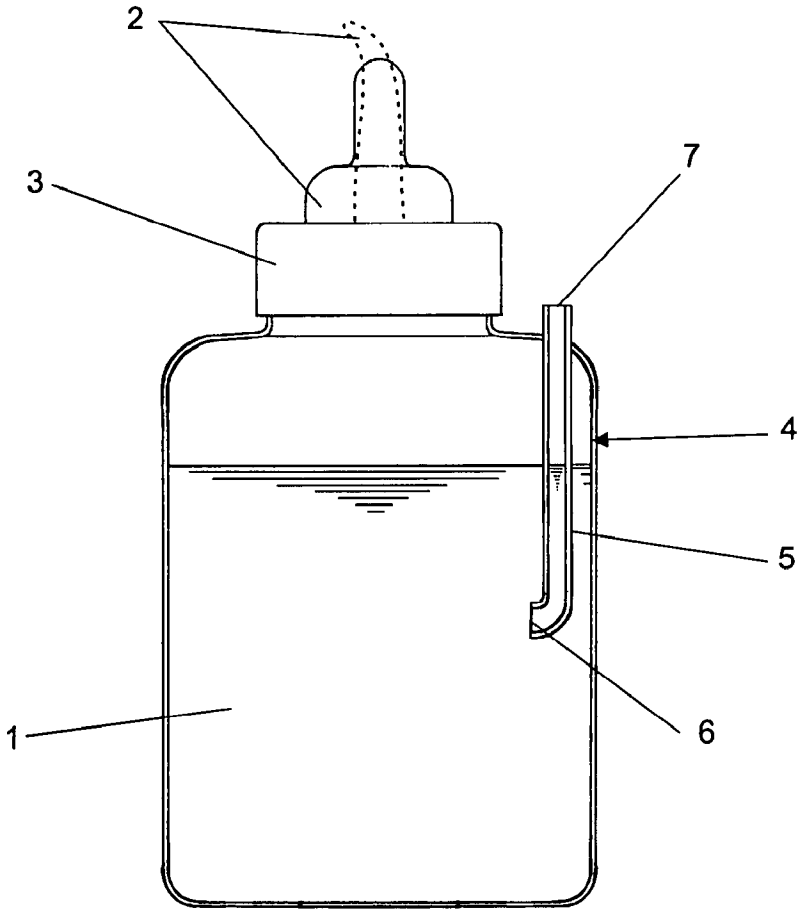

As previously explained, the air vent tube may be located in the external part (FIGS. 37 to 42) or in the internal part (FIGS. 43 and 44) in relation to the body of the container, where the upper end of the mentioned tube (5) is able to cross the container wall or be positioned passing through its lid (FIG. 44). Also, as shown by FIG. 45, the mentioned air vent tube (5) may be coupled to the container wall.

On the other hand, as shown by FIGS. 46 and 47, the air vent (4) may be constituted by a coupled wall (32) in the internal part of the container (1), making up a different duct (33) which will have, in its upper part, an opening (34) for air flow, while its lower part presents an opening (35) connected to the inside of the mentioned container (1).

Even with these constructive alternatives, the concept of communicating vessels is always present. In this case, the additional characteristic is the fact that not only the opening (35), but also the lower ends of the coupled or separate tubes have its ends positioned above the bottom of the mentioned container (1), which will produce the advantages previously mentioned.

The pouring or suction spout/nipple may present different shapes and may be positioned in several different ways in the lid (3) of the container (1) as long as it allows the fulfillment of the principle of communicating vessels.

It is also possible the use of stoppers or check valves in the air inlet of the air vent (4) that enables the automatic control of the external air inlet and that do not allow the outlet of the liquid, as explained previously. In this case, there will not be leakage regardless of the length or the position of the air vent tube.

Figure 40:
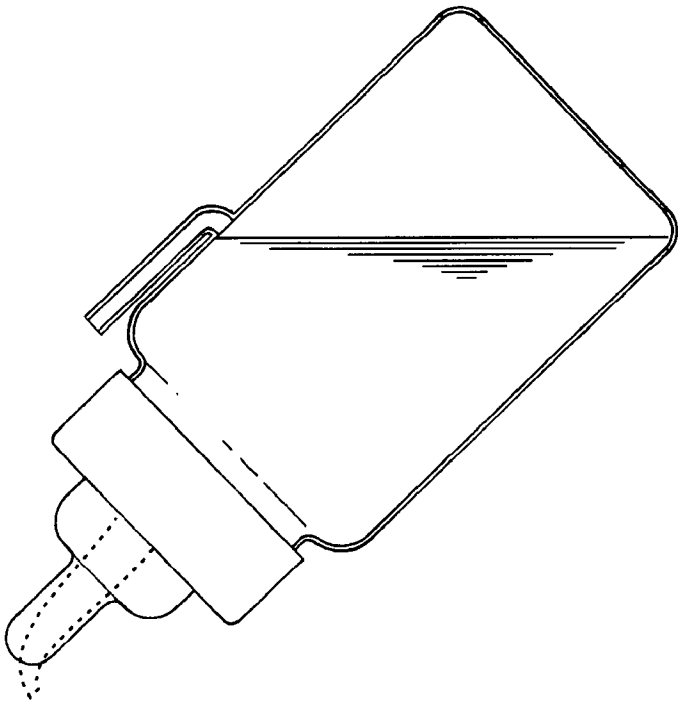
Figure 49:
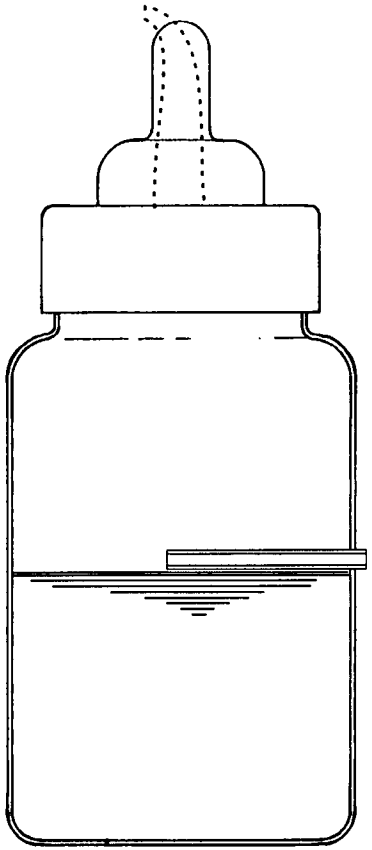
Figure 48:
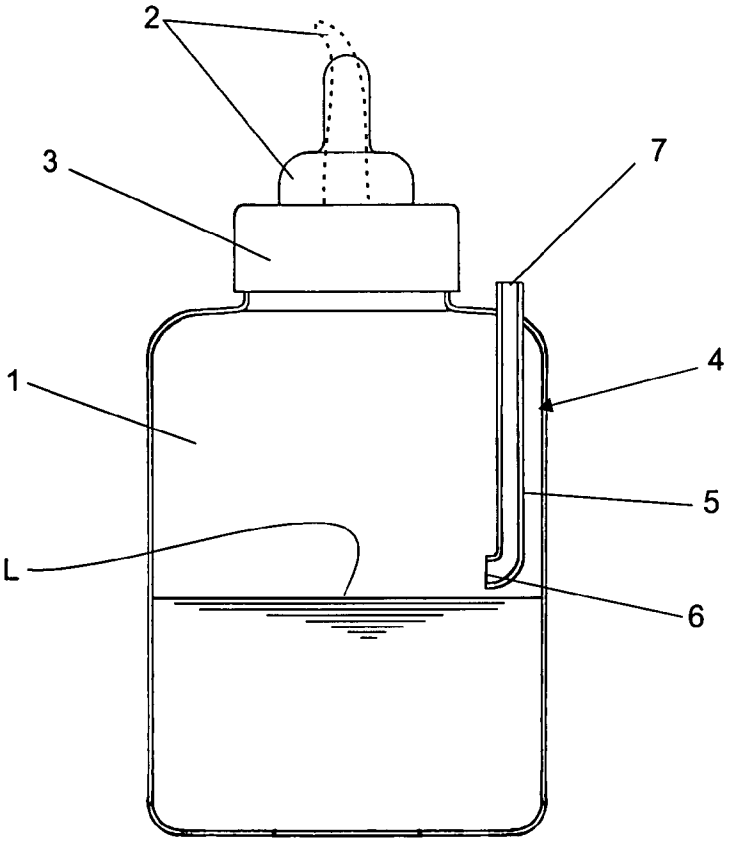

According to FIGS. 48 and 49, a constructive variation of what was said above, would be the design of a container with an air vent that will have its lower opening (6) above the level of the liquid, whether it is placed in a vertical or horizontal position. In the first case, for certain containers, the length of the air vent tube will define the allowed angle for the tilting of the container, without the occurrence of leakage through this tube, as above mentioned (FIG. 40). In the second case, and depending on the design of the container and on the length of the air vent tube, the container may be tilted up to 360 degrees, without the occurrence of leakage through the air vent. In both cases, the pouring procedure of the liquid will not trigger the occurrence of vacuum inside the container, as the external air will not pass through the liquid, since it is constantly in touch with the internal part of the container. In these two cases, given a certain amount of liquid, it will be necessary the use of a bigger container than when the tube is submerged in the liquid. In other words, when the principle of communicating vessels is applied. Usually, in containers available in the market, a simple orifice is made in the container wall, which works as an air vent, causing vacuum, the external air passes through the liquid and the tilting of the container is thus limited, as a leakage may occur through this orifice.

So far we have made an analysis of the internal air vent of the container, assembled near the container wall, whether it is fixed to the container wall or to the lid.

Figure 51:
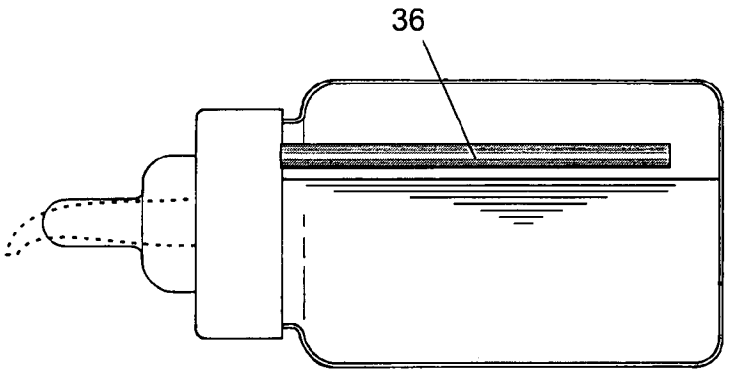
FIGS. 50 to 59 are several views of alternative constructions for the air vent tube placed in various positions inside the container or baby bottle and normally fixed on the lid.
Figure 52:
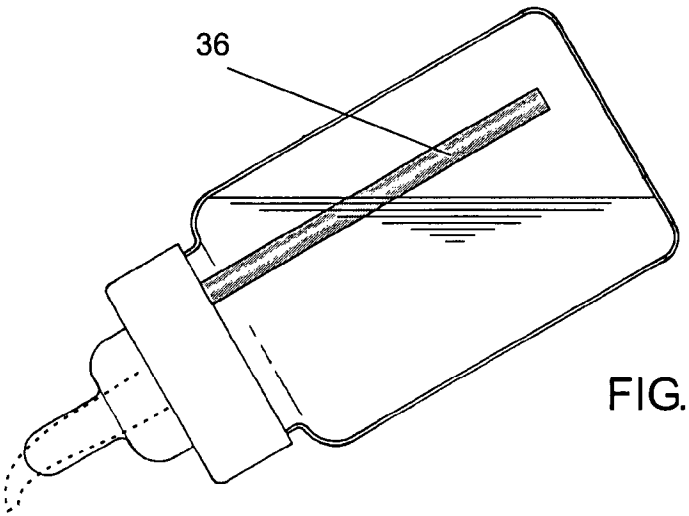
Figure 50:
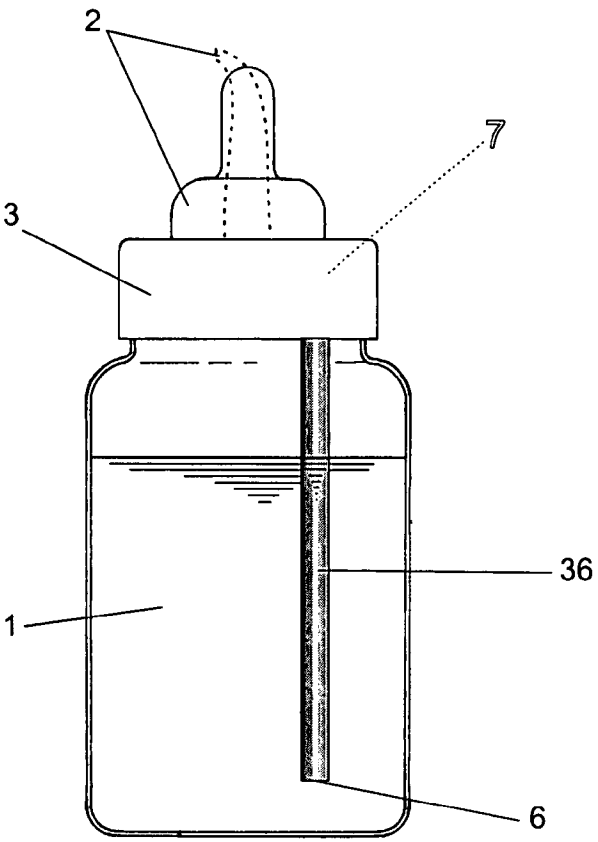
Figure 54:
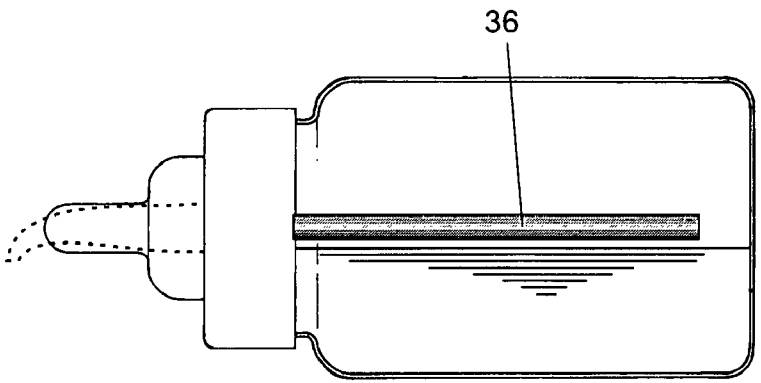
Figure 55:
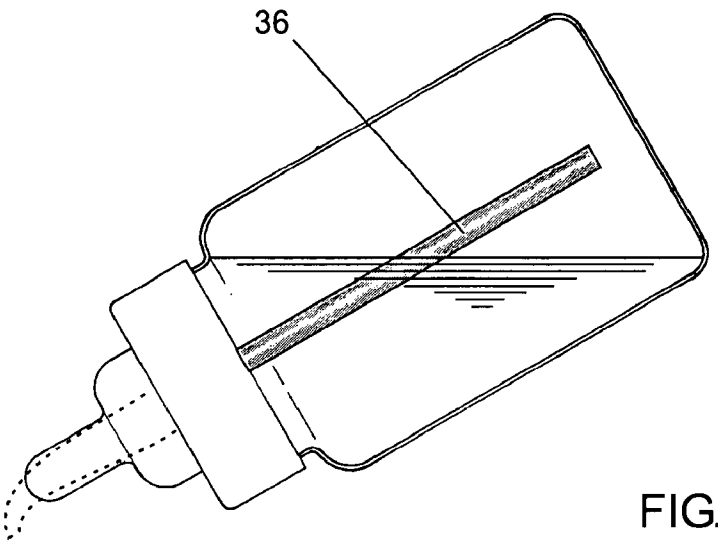
Figure 53:
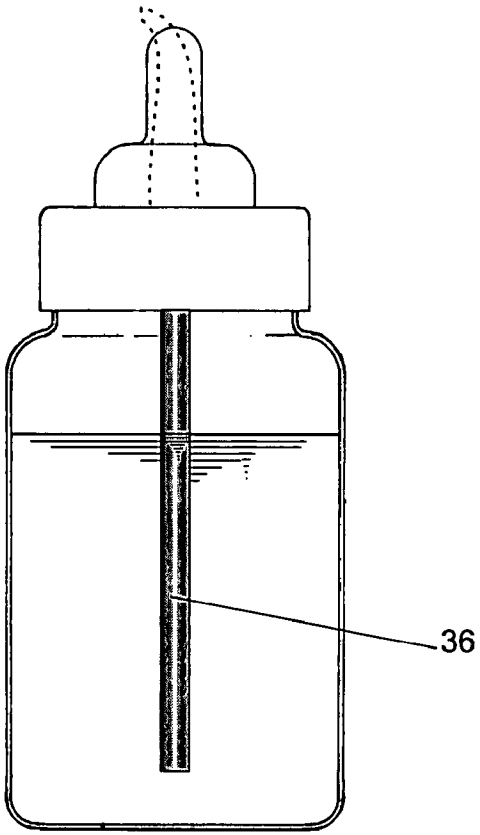
Figure 58:
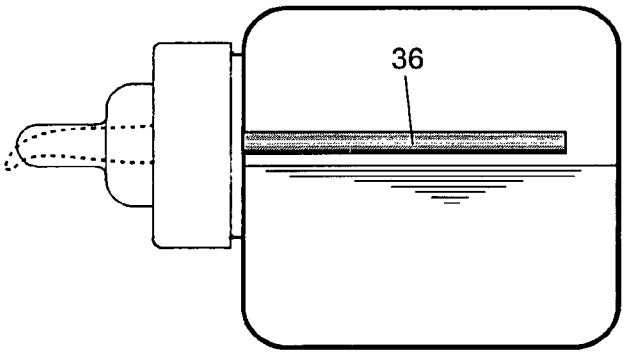
Figure 59:
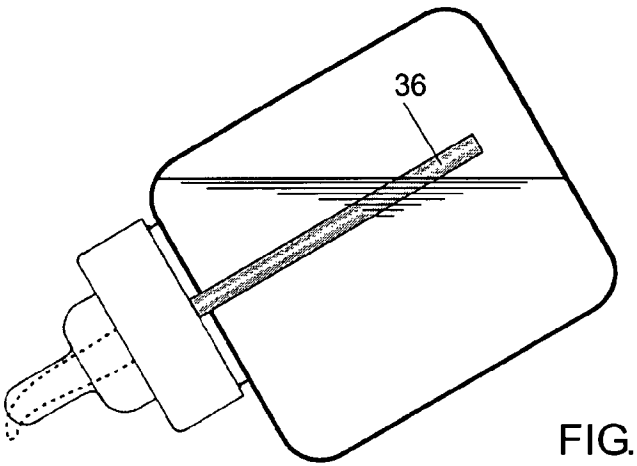
Figure 56:
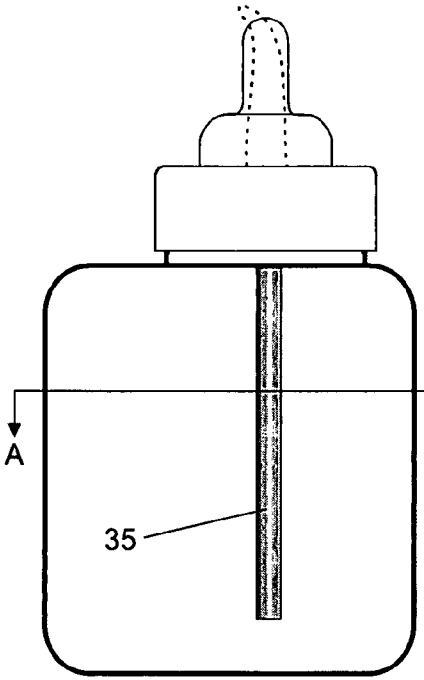
Figure 57:
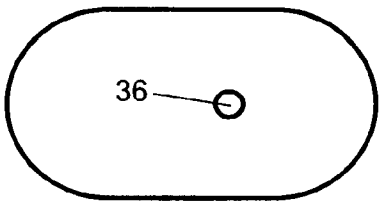

In another constructive alternative, shown in FIGS. 50 to 59, an additional characteristic is the fact that the air vent (4) is constituted by an internal tube (36), in a vertical position, placed in an axial or eccentrically, in other words, in any position, from its middle part to very near the container wall (1) and that may work according to the principle of communicating vessels. In these cases, the container must have either a different volume or shape, so that in its horizontal position, the level of the liquid, when the container is at its full capacity, will be below the bottom line of the air vent tube. As the level of the liquid is subsiding, this requirement will be obviously met. In this manner, as the container is tilted, the liquid inside the tube will already be in the bottom of the container, when it reaches the horizontal position, before the pouring or suction (FIGS. 51, 54 and 58). Therefore, at the start of the suction or pouring, there will not be any liquid in the air vent tube, and there will not be the possibility of leakage (FIGS. 52, 55 and 59).

The internal tube, be it axial or eccentric, may have its opening (7) for the air vent placed in its lid (3) or body of the container (1) or even to be built as a set along with the pouring or suction nipple/spout (2) as explained previously. The tube that makes up the air vent (4) regardless the way in which it is assembled, may have its lower end or opening (6) defined in different ways. The most proper design is the one that will allows a better drainage of the liquid from the tube to the bottom of the container.

As previously verified, two connecting side-by-side vessels, open to the atmosphere achieve the principle of communicating vessels. However, when one of the tubes (body of the container) presents a lid along with a pouring or suction spout and the other one (air vent tube) with a free opening to the atmosphere or it is closed, a proper design for the container will be necessary in order to fully achieve the principle of communicating vessels.

When the same idea is used in containers for domestic use, the principle of communicating vessels is partially or fully achieved, as it will depend on a series of factors.

Thus, the invention here presented, besides being a simple construction, may be used as follows:

1. In containers with special characteristics or specifically designed, with an air vent tube, through which the external air reaches the bottom of the container before the start of pouring or suction, due to a simple revolving movement in the container, and there will not be, thus, the creation of vacuum in the beginning and during the act of pouring, the external air will not pass through the liquid and there will not be the possibility of leakage. This will bring a series of advantages previously mentioned to exhaustion. This is a consequence of the application of the principle of communicating vessels.

2. In common containers available in the market, non-specifically designed, with an air vent tube as above described, through which the principle of communicating vessels may be fully or partially achieved, depending on the kind of container and on the pouring or suction spout/nipple. In the last case, the remains of the liquid inside the little tube will be sent to the bottom of the container at the start of the pouring or suction, in order to replace the liquid already poured. Then the external air is sent to the bottom of the container, without the formation of vacuum and the occurrence of leakage.

In a comparative analysis between what was exposed above and the characteristics of almost all containers available in the market:

These containers do not have air vent tubes in the pattern here described and, consequently, the external air enters either through the pouring and suction spout/nipple or through the orifice made in the container and reaches the bottom of the container through the liquid, after the starting of the pouring or suction of the liquid when vacuum is formed in its bottom. Vacuum will continue to be formed during the pouring so that the external air may go through the liquid and reach the bottom of the container, causing the pouring in gushes. The orifice of the air vent made in the container is the sole cause of leakage.

What is claimed is:

1. A container for containing and dispensing liquids, comprising:

a flask for containing a liquid, the flask comprising a bottom wall, a side wall joined to the bottom wall and extending upwardly therefrom, and a spout at a top end of the flask, the spout defining an access opening through which liquid may be dispensed, the side wall extending about a vertical axis of the flask so as to encompass a main internal space of the flask for holding liquid;

the flask further including an air vent that comprises:

a removable strip-shaped body having an internal face that defines a longitudinal groove therein;

a channel defined in an external surface of the side wall of the flask, the channel extending longitudinally along the flask and being configured to receive the removable strip-shaped body with the internal face of the strip-shaped body facing toward the main internal space of the flask such that an air duct is formed between the longitudinal groove and an external surface within the channel, the air duct defining an air inlet for admitting air external to the flask into the air duct; and a trespassing hole extending through the side wall of the flask in the region of the channel, the trespassing hole communicating with the main internal space of the flask and with the air duct, whereby the trespassing hole and the air duct form the air vent;

the container being configured such that when the flask is placed in a tilted position, air external to the flask passes through the air inlet into the air duct and through the trespassing hole into the main internal space of the flask before any liquid is discharged through the access opening of the spout, such that no vacuum is created in the main internal space of the flask.

2. The container of the claim 1, wherein the trespassing hole is proximate to and spaced above the bottom wall of the flask.

3. The container of claim 1, wherein the air inlet comprises a small diameter such that liquid in the flask cannot flow out through the air inlet.

4. The container of claim 1, wherein the flask comprises a lateral and longitudinal flattening along the entire height of the flask, on an opposite side of the flask from the air duct.

5. The container of the claim 1, wherein the air duct has a lower end positioned at a central portion of the height of the flask.

6. The container of the claim 1, wherein the air duct has a lower end positioned above the level of the liquid.

7. The container of the claim 1, wherein the flask further comprises an auxiliary external tube positioned on an outer surface of the flask, a first extremity of the auxiliary external tube defining an opening to the internal space of the flask, a second extremity of the flask defining an auxiliary air inlet, the auxiliary external tube comprising a small diameter such that liquid in the internal space of the flask cannot flow out through the auxiliary air inlet.

8. The container of claim 1, wherein the air vent is positioned along a perimeter of the side wall of the flask in such a way that the main internal space and the air duct contain equal heights of liquid when the main internal space and the air duct are both exposed to atmospheric pressure.

9. The container of claim 1, wherein the air vent extends parallel to the spout.

10. The container of claim 1, wherein the channel has a generally trapezoidal cross-sectional shape and the removable strip-shaped body has a complementary generally trapezoidal cross-sectional shape so as to fit into the channel in a form-locking manner.

* * * * *

UNITED STATES PATENT AND TRADEMARK OFFICE

CERTIFICATE OF CORRECTION

PATENT NO. : 8,196,785 B2
APPLICATION NO. : 12/914256
DATED : June 12, 2012
INVENTOR(S) : de Carvalho It is certified that error appears in the above-identified patent and that said Letters Patent is hereby corrected as shown below:

On the Title page, Item 30
"(30) Foreign Application Priority Data
Dec. 17, 2003 (BR) ..... 0300664"
should read
--(30) Foreign Application Priority Data
Dec. 17, 2003 (BR) .....C1 0300664-6
Apr. 16, 2004 (BR) .....C2 0300664-6--.

Signed and Sealed this
Twenty-second Day of January, 2013

David J. Kappos

David J. Kappos
*Director of the United States Patent and Trademark Office*